US011729871B2

(12) United States Patent
Libman et al.

(10) Patent No.: US 11,729,871 B2
(45) Date of Patent: Aug. 15, 2023

(54) SYSTEM AND METHOD FOR APPLYING ELECTROMAGNETIC ENERGY

(71) Applicant: JOLIET 2010 LIMITED, Caesarea (IL)

(72) Inventors: Avner Libman, Holon (IL); Sharon Hadad, Giv'ataim (IL); Caroline Myriam Rachel Obadia, Ashdod (IL); Natan Mizrahi, Giv'ataim (IL); Eran Ben-Shmuel, Savyon (IL); Alexander Bilchinsky, Monosson-Yahud (IL); Itzhak Chaimov, Mazkeret-Batya (IL)

(73) Assignee: JOLIET 2010 LIMITED, Tortola (VG)

( * ) Notice: Subject to any disclaimer, the term of this patent is extended or adjusted under 35 U.S.C. 154(b) by 474 days.

(21) Appl. No.: 16/855,757

(22) Filed: Apr. 22, 2020

(65) Prior Publication Data

US 2020/0253005 A1 Aug. 6, 2020

Related U.S. Application Data

(63) Continuation of application No. 13/080,072, filed on Apr. 5, 2011, now Pat. No. 10,674,570, which is a (Continued)

(51) Int. Cl.
*H05B 6/66* (2006.01)
*H05B 6/64* (2006.01)
(Continued)

(52) U.S. Cl.
CPC ..... *H05B 6/666* (2013.01); *H05B 6/647* (2013.01); *H05B 6/686* (2013.01); *H05B 6/688* (2013.01); *H05B 6/705* (2013.01)

(58) Field of Classification Search
CPC ..... H05B 6/666; H05B 6/647; H05B 6/686; H05B 6/688; H05B 6/705
See application file for complete search history.

(56) References Cited

U.S. PATENT DOCUMENTS 2,489,337 A 11/1949 Sperling
2,543,130 A 2/1951 Robertson
(Continued)

FOREIGN PATENT DOCUMENTS

CN 1496665 5/2004
CN 1968609 5/2007
(Continued)

OTHER PUBLICATIONS

U.S. Appl. No. 60/775,231, filed Feb. 21, 2006, Ben-Shmuel et al.
(Continued)

*Primary Examiner* — Benjamin Tzu-Hung Liu
(74) *Attorney, Agent, or Firm* — Finnegan, Henderson, Farabow, Garrett & Dunner LLP

(57) ABSTRACT

An apparatus for applying electromagnetic energy to an object in an energy application zone via at least one radiating element is disclosed. The apparatus may include at least one processor. The at least one processor may be configured to determine a value indicative of energy absorbable by the object at each of a plurality of frequencies and to cause the at least one radiating element to apply energy to the zone in at least a subset of the plurality of frequencies. Energy applied to the zone at each of the subset of frequencies may be a function of the absorbable energy value at each frequency.

31 Claims, 21 Drawing Sheets

Related U.S. Application Data continuation-in-part of application No. 12/222,948, filed on Aug. 20, 2008, now Pat. No. 8,207,479, which is a continuation of application No. PCT/IL2007/000236, filed on Feb. 21, 2007.

(60) Provisional application No. 60/806,860, filed on Jul. 10, 2006, provisional application No. 60/775,231, filed on Feb. 21, 2006.

(51) Int. Cl.
*H05B 6/68* (2006.01)
*H05B 6/70* (2006.01)

(56) References Cited

U.S. PATENT DOCUMENTS 2,593,067 A 4/1952 Spencer
2,895,828 A 7/1959 Kamide
2,917,739 A 12/1959 Halpern
3,019,399 A 1/1962 Lanciani et al.
3,151,325 A 9/1964 Kompfner
3,231,892 A 1/1966 Matson et al.
3,633,538 A 1/1972 Hoeflin
3,681,652 A 8/1972 Domenichini et al.
3,767,884 A 10/1973 Osepchuk et al.
3,806,689 A 4/1974 Kegereis et al.
3,936,627 A 2/1976 Fitzmayer
3,985,993 A 10/1976 Imberg et al.
4,035,599 A 7/1977 Kashyap et al.
4,081,647 A 3/1978 Torrey
4,115,680 A 9/1978 Moore
4,137,441 A 1/1979 Bucksbaum
4,146,768 A 3/1979 Orke et al.
4,165,454 A 8/1979 Carlsson et al.
4,196,332 A 4/1980 MacKay et al.
4,210,795 A * 7/1980 Lentz ..... H05B 6/6432 219/709
4,250,628 A 2/1981 Smith et al.
4,271,848 A 6/1981 Turner et al.
4,279,722 A 7/1981 Kirkbridge
4,289,945 A 9/1981 Kristof
4,297,557 A 10/1981 Tyler et al.
4,336,435 A 6/1982 Kashyap et al.
4,342,035 A 7/1982 Anderson et al.
4,342,896 A 8/1982 Teich
4,354,153 A 10/1982 Lentz
4,371,770 A 2/1983 Gilliatt
4,377,733 A 3/1983 Yamaguchi et al.
4,418,262 A 11/1983 Noda
4,431,888 A 2/1984 Simpson
4,434,341 A 2/1984 Busby
4,441,002 A 4/1984 Teich et al.
4,447,693 A 5/1984 Buck
4,464,554 A 8/1984 Bakanowski et al.
4,471,194 A 9/1984 Hosokawa et al.
4,475,024 A 10/1984 Tateda
4,485,285 A 11/1984 Machesney
4,488,027 A 12/1984 Dudley et al.
4,507,530 A 3/1985 Smith
4,508,948 A 4/1985 Carlson
4,517,429 A 5/1985 Horinouchi
4,520,250 A 5/1985 Ishihara et al.
4,568,810 A 2/1986 Carmean
4,589,423 A 5/1986 Turner
4,596,915 A 6/1986 Simpson
4,602,141 A 7/1986 Naito et al.
4,629,849 A 12/1986 Mizutani et al.
4,695,694 A 9/1987 Hill et al.
4,794,218 A 12/1988 Nakano et al.
4,795,871 A 1/1989 Strattan et al.
4,822,968 A 4/1989 Chin
4,855,555 A 8/1989 Adams et al.
4,897,151 A 1/1990 Killackey et al.
4,931,798 A 6/1990 Kogo
4,963,709 A 10/1990 Kimrey, Jr.
5,008,506 A 4/1991 Asmussen et al.
5,036,171 A 7/1991 Kim et al.
5,036,172 A 7/1991 Kokkeler et al.
5,044,006 A 8/1991 Cyrulnik
5,066,503 A 11/1991 Rouzi
5,074,200 A 12/1991 Rouzi
5,140,121 A 8/1992 Pesheck et al.
5,146,059 A 9/1992 Seog Tae
5,191,182 A 3/1993 Galorme et al.
5,202,095 A 4/1993 Houchin et al.
5,251,645 A 10/1993 Fenn
5,284,144 A 2/1994 Delannoy et al.
5,293,019 A 5/1994 Lee
5,321,222 A 6/1994 Bible et al.
5,321,897 A 6/1994 Holst et al.
5,441,532 A 8/1995 Fenn
5,451,751 A 9/1995 Takimoto et al.
5,468,940 A 11/1995 Kang
5,503,150 A 4/1996 Evans
5,512,736 A 4/1996 Kang et al.
5,521,360 A 5/1996 Johnson et al.
5,558,800 A 9/1996 Page
5,616,268 A 4/1997 Carr
5,632,921 A 5/1997 Risman et al.
5,648,038 A 7/1997 Fathi et al.
5,698,128 A 12/1997 Sakai et al.
5,721,286 A 2/1998 Lauf et al.
5,789,724 A 8/1998 Lerssen et al.
5,798,395 A 8/1998 Lauf et al.
5,804,801 A 9/1998 Lauf et al.
5,812,393 A 9/1998 Drucker
5,818,649 A 10/1998 Anderson
5,828,040 A 10/1998 Risman
5,828,042 A 10/1998 Choi et al.
5,834,744 A 11/1998 Risman
5,837,978 A 11/1998 Hatzakis, Jr. et al.
5,873,254 A 2/1999 Arav
5,877,479 A 3/1999 Yu
5,883,801 A 3/1999 Drucker et al.
5,889,402 A 3/1999 Kumatoriya et al.
5,927,265 A 7/1999 McKee et al.
5,942,144 A 7/1999 Lee
5,958,278 A 9/1999 Engebritson et al.
5,961,871 A 10/1999 Bible et al.
5,977,532 A 11/1999 Ekemar
5,981,927 A 11/1999 Osepchuk et al.
5,981,928 A 11/1999 Lee
5,986,249 A 11/1999 Yoshino et al.
5,998,775 A 12/1999 Sung
6,060,701 A 5/2000 McKee et al.
6,096,361 A 8/2000 Yamane et al.
6,104,018 A 8/2000 Varma et al.
6,114,677 A 9/2000 Idomolo et al.
6,157,014 A 12/2000 Goranson
6,166,551 A 12/2000 Scott et al.
6,169,277 B1 1/2001 Feher et al.
6,172,348 B1 1/2001 Yoshino et al.
6,191,402 B1 2/2001 Ekemar
6,222,170 B1 4/2001 Tucker et al.
6,225,940 B1 5/2001 Ohlsen
6,249,710 B1 6/2001 Drucker et al.
6,252,206 B1 6/2001 Leukhardt et al.
6,262,406 B1 7/2001 McKee et al.
6,263,830 B1 7/2001 Kamarehi et al.
6,274,859 B1 8/2001 Yoshino et al.
6,320,165 B1 11/2001 Ovadia
6,320,169 B1 11/2001 Clothier
6,320,171 B1 11/2001 Kim
6,384,392 B1 5/2002 Lee et al.
6,403,939 B1 6/2002 Fagrell
6,444,966 B2 9/2002 Mukumoto et al.
6,462,320 B1 10/2002 Fuls et al.
6,476,766 B1 11/2002 Cohen
6,487,950 B2 12/2002 Samland
6,537,492 B1 3/2003 Søgaard
6,559,882 B1 5/2003 Kerchner
6,563,097 B2 5/2003 Taino et al.
6,576,879 B1 6/2003 Hoh

(56) References Cited

U.S. PATENT DOCUMENTS 6,586,714 B2 7/2003 Kawamura et al.
6,590,192 B2 7/2003 Taino et al.
6,606,483 B1 8/2003 Baker et al.
6,614,011 B2 9/2003 Omori et al.
6,638,475 B1 10/2003 Lagunas-Solar et al.
6,657,173 B2 12/2003 Flugstad et al.
6,674,056 B2 1/2004 Lee
6,680,467 B1 1/2004 Whipple, Jr.
6,686,567 B1 2/2004 Hwang
6,720,541 B2 4/2004 Watanabe et al.
6,770,859 B2 8/2004 Kang
6,807,446 B2 10/2004 Fenn et al.
6,812,442 B2 11/2004 Kim et al.
6,812,443 B2 11/2004 Noda et al.
6,815,644 B1 11/2004 Muegge et al.
6,838,648 B2 1/2005 Watanabe et al.
6,861,632 B2 3/2005 Lee
6,867,402 B1 3/2005 Schulte
6,874,495 B2 4/2005 McFadden
6,880,545 B2 4/2005 Heber et al.
6,884,979 B1 4/2005 Torngren et al.
6,914,226 B2 7/2005 Ottaway
6,917,023 B2 7/2005 Hayes et al.
6,927,374 B2 8/2005 Hu et al.
6,953,919 B2 10/2005 Clothier
6,982,401 B2 1/2006 Hu et al.
7,015,443 B2 3/2006 Whipple, Jr.
7,030,347 B2 4/2006 Lee et al.
7,053,346 B2 5/2006 Cheng et al.
7,053,348 B1 5/2006 Terada et al.
7,055,518 B2 6/2006 McFadden et al.
7,060,953 B2 6/2006 Ishikawa et al.
7,070,595 B2 7/2006 Ormsby et al.
7,078,661 B2 7/2006 Kim et al.
7,080,593 B1 7/2006 Frankel
7,087,872 B1 8/2006 Dobie et al.
7,091,460 B2 8/2006 Kinzer
7,096,221 B2 8/2006 Nakano
7,105,787 B2 9/2006 Clemen, Jr.
7,105,789 B2 9/2006 Ekemar
7,109,457 B2 9/2006 Kinzer
7,145,119 B1 12/2006 Kim et al.
7,166,824 B2 1/2007 Kanzaki et al.
7,199,341 B2 4/2007 Kaneko et al.
7,207,486 B1 4/2007 Bennett
7,208,710 B2 4/2007 Gregoire et al.
7,235,763 B2 6/2007 Christiaansen et al.
7,258,881 B2 8/2007 Jones et al.
7,360,533 B2 4/2008 McFadden
7,361,866 B2 4/2008 Chun
7,372,209 B2 5/2008 Espiau et al.
7,388,180 B2 6/2008 Kim et al.
7,409,311 B2 8/2008 Imgram et al.
7,473,869 B2 1/2009 Chun
7,490,538 B2 2/2009 Lowell et al.
7,612,315 B2 11/2009 Corradini
7,626,468 B2 12/2009 Staines
7,629,497 B2 12/2009 Pringle
7,629,921 B1 12/2009 Manry et al.
8,207,479 B2 6/2012 Ben-Shmuel et al.
8,759,729 B2 6/2014 Ben-Shmuel et al.
2001/0015353 A1 8/2001 Brennan
2001/0020616 A1 9/2001 Drozd et al.
2002/0018138 A1 2/2002 Yoshiro
2002/0162836 A1 11/2002 Taino et al.
2002/0175163 A1* 11/2002 Fagrell ..... H05B 6/806 204/157.43
2003/0047559 A1 3/2003 Watanabe et al.
2003/0068414 A1 4/2003 Ito
2003/0106891 A1 6/2003 Fagrell et al.
2003/0183972 A1 10/2003 Weber et al.
2004/0069776 A1 4/2004 Fagrell et al.
2004/0074401 A1 4/2004 McMaster et al.
2004/0106917 A1 6/2004 Ormsby et al.
2004/0134904 A1 7/2004 Clemen, Jr.
2004/0149736 A1 8/2004 Clothier
2004/0206755 A1 10/2004 Hadinger
2004/0211765 A1 10/2004 McFadden
2004/0216732 A1 11/2004 McFadden
2004/0232140 A1 11/2004 Kanzaki et al.
2005/0080373 A1 4/2005 Wang
2005/0092314 A1 5/2005 Rabas et al.
2005/0092844 A1 5/2005 Zhang et al.
2005/0139686 A1 6/2005 Helmer et al.
2005/0178841 A1 8/2005 Jones, II et al.
2005/0230385 A1 10/2005 Lee et al.
2006/0006173 A1 1/2006 Kim et al.
2006/0049725 A1 3/2006 Simon
2006/0049981 A1 3/2006 Merkel et al.
2006/0186115 A1 8/2006 Jones et al.
2006/0259547 A1 11/2006 Bogatin et al.
2006/0278710 A1 12/2006 Park et al.
2006/0289499 A1 12/2006 Chun
2006/0289508 A1 12/2006 Kim
2006/0289526 A1 12/2006 Takizaki et al.
2007/0007279 A1 1/2007 Chun et al.
2007/0007348 A1 1/2007 Shah
2007/0012690 A1 1/2007 Sim et al.
2007/0012789 A1 1/2007 Hartney et al.
2007/0039940 A1 2/2007 Kim et al.
2007/0137633 A1 6/2007 McFadden
2007/0215608 A1 9/2007 Yoshino et al.
2007/0215612 A1 9/2007 Hicks et al.
2007/0221668 A1 9/2007 Baarman et al.
2007/0251941 A1 11/2007 Givens
2007/0272684 A1 11/2007 Lee
2007/0278218 A1 12/2007 Claesson et al.
2008/0047948 A1 2/2008 Rosenbloom et al.
2008/0047959 A1 2/2008 Moriya et al.
2008/0087662 A1 4/2008 Takizaki et al.
2008/0105136 A1 5/2008 McFadden
2008/0105675 A1 5/2008 Choi et al.
2008/0106483 A1 5/2008 McFadden et al.
2008/0160967 A1 7/2008 Narasimhan et al.
2008/0193614 A1 8/2008 Greiner et al.
2008/0206420 A1 8/2008 McFadden
2008/0264269 A1 10/2008 Sterzel et al.
2008/0280000 A1 11/2008 Breunig et al.
2008/0290087 A1 11/2008 Ben-Shmuel et al.
2008/0290178 A1 11/2008 Reynolds et al.
2008/0296284 A1 12/2008 McFadden et al.
2009/0014315 A1 1/2009 Chen
2009/0045191 A1 2/2009 Ben-Shmuel et al.
2009/0057302 A1 3/2009 Ben-Shmuel et al.
2009/0071110 A1 3/2009 Gonze et al.
2009/0236333 A1 9/2009 Ben-Shmuel et al.
2009/0236334 A1 9/2009 Ben-Shmuel et al.
2009/0236335 A1 9/2009 Ben-Shmuel et al.
2009/0256706 A1 10/2009 Brown
2009/0274802 A1 11/2009 Kling et al.
2010/0006564 A1 1/2010 Ben-Shmuel et al.
2010/0123001 A1 5/2010 Park
2010/0155392 A1 6/2010 Nordh et al.
2010/0176121 A1 7/2010 Tomotaka et al.
2010/0237067 A1 9/2010 Nordh et al.
2010/0252551 A1 10/2010 Nordh et al.
2011/0017728 A1 1/2011 Ben-Shmuel et al.
2011/0031240 A1 2/2011 Ben-Shmuel et al.
2012/0067872 A1 3/2012 Libman et al.
2012/0267361 A1 10/2012 Ben-Shmuel et al.

FOREIGN PATENT DOCUMENTS

DE 3326514 A1 1/1984
DE 102007025245 10/2007
DE 102007025262 10/2007
DE 102007025263 10/2007
DE 102007025264 10/2007
DE 102007035357 2/2009
DE 102007035359 2/2009
DE 102007051638 8/2009
EP 0268379 5/1988
EP 0296527 A2 6/1988
EP 0429822 6/1991

(56) References Cited

FOREIGN PATENT DOCUMENTS

| | | | |
|---|---|---|---|
| EP | 0 268 379 | B1 | 8/1992 |
| EP | 0615763 | | 9/1994 |
| EP | 0752195 | | 1/1997 |
| EP | 0788296 | A1 | 8/1997 |
| EP | 0934681 | | 8/1999 |
| EP | 1174667 | A1 | 1/2002 |
| EP | 1241923 | A1 | 9/2002 |
| EP | 1333012 | A1 | 8/2003 |
| EP | 1149234 | A2 | 10/2003 |
| EP | 1349234 | A2 | 10/2003 |
| EP | 1 447 632 | A1 | 8/2004 |
| EP | 0 753 240 | B1 | 10/2004 |
| EP | 0753240 | | 10/2004 |
| EP | 1515102 | | 3/2005 |
| EP | 1587345 | A2 | 10/2005 |
| EP | 1708118 | A2 | 10/2006 |
| EP | 1987288 | | 11/2008 |
| EP | 2053315 | | 4/2009 |
| EP | 2098788 | | 9/2009 |
| EP | 2528413 | | 11/2012 |
| GB | 1465106 | | 2/1977 |
| GB | 2391154 | | 1/2004 |
| JP | 52-014946 | | 2/1977 |
| JP | 55-12551 | | 1/1978 |
| JP | 5179382 | | 1/1978 |
| JP | 57-194500 | | 11/1982 |
| JP | 58-111295 | | 7/1983 |
| JP | 60-193292 | | 10/1985 |
| JP | 63-255783 | A | 10/1988 |
| JP | 1-159388 | | 11/1989 |
| JP | 04-259789 | | 9/1992 |
| JP | 04-299282 | | 10/1992 |
| JP | 6-193884 | A | 5/1994 |
| JP | 06-215871 | | 8/1994 |
| JP | 06-251866 | | 9/1994 |
| JP | 6-310268 | | 11/1994 |
| JP | 8-64359 | | 3/1996 |
| JP | 9-229372 | | 9/1997 |
| JP | 9-511355 | | 11/1997 |
| JP | 10-196966 | | 7/1998 |
| JP | 2000-357583 | | 12/2000 |
| JP | 2001-086967 | | 4/2001 |
| JP | 2001-317741 | | 11/2001 |
| JP | 2002-37420 | A1 | 2/2002 |
| JP | 2002-243161 | A1 | 8/2002 |
| JP | 2002-280159 | | 9/2002 |
| JP | 2002-532239 | | 10/2002 |
| JP | 2004-171852 | | 6/2004 |
| JP | 2005-228604 | | 8/2005 |
| JP | 2008-034244 | | 2/2008 |
| KR | 1020050058824 | A | 6/2005 |
| WO | WO 1991/007069 | | 5/1991 |
| WO | WO 1995/027387 | | 10/1995 |
| WO | WO 1995/027388 | | 10/1995 |
| WO | WO 1997/036728 | | 10/1997 |
| WO | WO 1999/013688 | | 3/1999 |
| WO | WO 00/36880 | | 6/2000 |
| WO | WO 2000/036880 | | 6/2000 |
| WO | WO 00/52970 | | 9/2000 |
| WO | WO 2001/062379 | | 8/2001 |
| WO | WO 2002/023953 | | 3/2002 |
| WO | WO 2002/035886 | | 5/2002 |
| WO | WO 2003/056919 | | 7/2002 |
| WO | WO 2004/010740 | | 1/2004 |
| WO | WO 2004/054705 | | 7/2004 |
| WO | WO 2004/059563 | | 7/2004 |
| WO | WO 2004/093499 | | 10/2004 |
| WO | WO 2005/027644 | | 3/2005 |
| WO | WO 2005/041672 | | 5/2005 |
| WO | WO 2005/073449 | | 7/2005 |
| WO | WO 2006/016372 | | 2/2006 |
| WO | WO 2007/018565 | | 2/2007 |
| WO | WO 2007/095904 | | 8/2007 |
| WO | WO 2007/096878 | | 8/2007 |
| WO | WO 2005/106333 | | 9/2007 |
| WO | WO 2007/096877 | | 9/2007 |
| WO | WO 2008/007368 | | 1/2008 |
| WO | WO 2008/048497 | | 4/2008 |
| WO | WO 2008/087618 | | 7/2008 |
| WO | WO 2008/102334 | | 8/2008 |
| WO | WO 2008/102360 | | 8/2008 |
| WO | WO 2008/143942 | | 11/2008 |
| WO | WO 2008/145213 | | 12/2008 |
| WO | WO 2008/145214 | | 12/2008 |
| WO | WO 2008/145216 | | 12/2008 |
| WO | WO 2008/145217 | | 12/2008 |
| WO | WO 2009/08344 | | 7/2009 |
| WO | WO 2009/080344 | A2 | 7/2009 |
| WO | WO 2009/104191 | | 8/2009 |
| WO | WO 2010/052724 | | 5/2010 |
| WO | WO 2010/052725 | | 5/2010 |
| WO | WO 2010/147439 | A2 | 12/2010 |

OTHER PUBLICATIONS

U.S. Appl. No. 60/806,860, filed Jul. 10, 2006, Ben-Shmuel et al.

Communication pursuant to Article 94(3) EPC, dated Mar. 22, 2012, in related European Patent Application No. 07 706 172.9 (4 pages).

Communication Relating to the Results of the Partial International Search, dated Jul. 10, 2007, for International Application No. PCT/IL2007/000235, from the International Searching Authority.

European Search Report dated Jun. 10, 2013, in related European Patent Application No. EP 12 16 5499.0 (6 pages).

First Office Action dated Feb. 17, 2012 in related Japanese Patent Application No. 2008-555943 (5 pages).

Geedipalli et al., "Heat Transfer in A Combination Microwave-Jet Impingement Oven," *Food and Bioproducts Processing*, vol. 86, pp. 53-63, 2008.

Hambling, "Forget Lasers, Phasers and Other Beam Weapons—Radiofrequency Devices Are Here, and They're Set to 'Sting,'" *Tech Watch: Forecasting Pain*, vol. 183, No. 12, p. 32, Dec. 2006.

Herring et al. "OSU Tunes Into a Cooking Innovation", OSU News & Communication Services, Oregon State University, 2 P., Apr. 30, 2004.

Hirsch et al., "Indicators of Erythocyte Damage After Microwave Warming of Packed Red Blood Cells," *Clinical Chemistry*, vol. 49, No. 5, pp. 792-799, 2003.

Hirsch et al., "Temperature Course and Distribution During Plasma Heating With a Microwave Device," *Anaesthesia*, vol. 58, pp. 444-447, 2003.

International Preliminary Report on Patentability and Written Opinion dated Aug. 26, 2009 From the International Preliminary Examining Authority Re.: Application No. PCT/IL2008/000231. (6 pages.).

International Preliminary Report on Patentability and Written Opinion dated Aug. 26, 2009 From the International Bureau of WIPO Re.: Application No. PCT/IL2007/001073.

International Preliminary Report on Patentability and Written Opinion dated Jan. 13, 2009 From the International Bureau of WIPO Re.: Application No. PCT/IL2007/000864.

International Preliminary Report on Patentability dated Aug. 26, 2008 From the International Preliminary Examining Authority Re.: Application No. PCT/IL2007/000235.

International Preliminary Report on Patentability dated May 29, 2008, from the International Preliminary Examining Authority Re: Application No. PCT/IL2007/000236.

International Search Report and the Written Opinion dated Jun. 15, 2010 From the International Searching Authority Re.: Application No. PCT/IL2009/001058.

International Search Report and the Written Opinion dated Jun. 24, 2010 From the International Searching Authority Re.: Application No. PCT/IL2009/001059.

International Search Report and the Written Opinion dated Nov. 25, 2009 From the International Searching Authority Re.: Application No. PCT/IL2009/000199.

International Search Report and Written Opinion dated Mar. 3, 2010 From the International Searching Authority Re.: Application No. PCT/IL2009/001057.

(56) References Cited

OTHER PUBLICATIONS

International Search Report and Written Opinion dated Sep. 11, 2007 From the International Searching Authority by the Patent Cooperation Treaty Re.: Application No. PCT/IL2007/000235.
International Search Report and Written Opinion dated Nov. 13, 2008 From the International Searching Authority Re.: Application No. PCT/IL2008/000231.
International Search Report and Written Opinion dated Jun. 15, 2010 From the International Searching Authority Re.: Application No. PCT/IL2009/001058.
International Search Report and Written Opinion dated May 20, 2008 From the International Searching Authority by the Patent Cooperation Treaty Re.: Application No. PCT /IL2007/001073.
International Search Report and Written Opinion dated Dec. 27, 2007 From the International Searching Authority by the Patent Cooperation Treaty Re.: Application No. PCT/IL2007/000864.
International Search Report and Written Opinion dated Aug. 31, 2007 From the International Searching Authority by the Patent Cooperation Treaty Re.: Application No. PCT/IL20007/000236.
International Search Report and Written Opinion regarding International Application No. PCT/IL10100380, dated Aug. 30, 2010, 12 pages.
International Search Report and Written Opinion regarding International Application No. PCT/IL10100381, dated Sep. 1, 2010, 124 pages.
International Search Report and Written Opinion, dated Jun. 15, 2010, for International Application No. PCT/IL2009/001058, from the International Searching Authority.
International Search Report and Written Opinion, dated Jun. 24, 2010, for International Application No. PCT/IL2009/001059, from the International Searching Authority.
International Search Report and Written Opinion, dated Nov. 25, 2009, for International Application No. PCT/IL2009/000199, from the International Searching Authority.
International Search Report dated Mar. 3, 2010 From the International Searching Authority Re.: Application No. PCT/IL2009/001057.
International Search Report dated Sep. 11, 2007 From the International Searching Authority by the Patent Cooperation Treaty Re.: Application No. PCT/IL2007/000235.
International Search Report dated Nov. 13, 2008 From the International Searching Authority Re.: Application No. PCT/IL2008/000231.
International Search Report dated May 20, 2008 From the International Searching Authority by the Patent Cooperation Treaty Re.: Application No. PCT/1L2007/001073.
International Search Report dated Aug. 31, 2007 From the International Searching Authority by the Patent Cooperation Treaty Re.: Application No. PCT/IL20007/000236.
International Search Report dated Nov. 13, 2008 from the International Searching Authority Re: Application No. PCT/2008/000231.
Invitation Pursuant to Rule 63(1) EPC dated Dec. 18, 2012, in related European Patent Application No. 12 165 473.5 (5 pages).
Invitation Pursuant to Rule 63(1) EPC dated Jan. 28, 2013, in related European Patent Application No. 12 165 499.0 (5 pages).
J. R. Bows, "Variable Frequency Microwave Heating of Food", Journal of Microwave Power and Electromagnetic Energy 34(4), 1999, pp. 227-238.
Khummongkol et al. "Heat Transfer Between Impinging Air and Impinged Surface: A Factorial Design", The Joint International Conference on 'Sustainable Energy and Environment (SEE)', Hua Hin, Thailand, Dec. 1-3, 2004, 4-003(O): 431-436, 2004.
Kim, J. et al., "Novel Microstrip-to-Stripline Transitions for Leakage Suppression in Multilayer Microwave Circuits."
Kusama, Y. et al., "A Study on the Door Seal Structure of a Microwave Oven Using the Finite-Difference Time-Domain Method," *Microwave and Optical Technology Letters*, vol. 19, No. 5, Dec. 5, 1998.
Kusama, Y. et al., "Analysis of Door Seal Structure of Microwave Oven with Consideration of Higher Modes by the FDTD Method," *Electronics and Communications in Japan*, Part 2, vol. 85, No. 3, 2002.
Kusama, Y. et al., "Size Reduction of the Door Seal Structure of a Microwave Oven by the FDTD Method," *Electronics and Communications in Japan*, Part 2, vol. 86, No. 10, 2003.
Lapin N9GL's RF Safety Column: The Military's New RF Weapon, ARRL Handbook for Radio Amateurs, ARRL Web: N9GL's RF Safety Column: The Military's New RF Weapon.
Lee, G. et al., "Suppression of the CPW Leakage in Common Millimeter-Wave Flip-Chip Structures," *IEEE Microwave and Guided Wave Letters*, vol. 8, No. 11, Nov. 11, 1998.
Liang et al. "Multiband Characteristics of Two Fractal Antennas", Microwave and Optical Technology Letters, 23(4): 242-245, Nov. 20, 1999.
Mackay et al., "Frequency Agile Sources for Microwave Ovens", Journal of Microwave Power 14(1), 1979, pp. 1-14.
Marcroft et al. "Flow Field in a Hot Air Jet Impingement Oven—Part I: A Single Impinging Jet", Journal of Food Processing Preservation, 23: 217-233, 1999.
Matsumoto, K. et al., "An Analysis of a Door Seal Structure of a Microwave Oven with an Inserted Sheet-Type Lossy Material Using FDTD Method," *Electronics and Communications in Japan*, Part 1, vol. 85, No. 9, 2002.
Matsumoto, K. et al., "An efficient Analysis on Door structure of Microwave Oven Using Combined waves of High Order Modes," *33rd European Microwave Conference*, Munich, 2003.
Mett, R. R et al., "Microwave leakage from field modulation slots in TE011 electron paramagnetic resonance cavities," *Review of Scientific Instruments* 76, 014702, 2005.
Minutes of the Oral Proceedings held on Jan. 18, 2013 and Annex, in related European Patent Application No. 07 706 172.9 (22 pages).
Notice of Allowance issued by the United States Patent and Trademark Office in U.S. Appl. No. 13/464,754 dated Apr. 28, 2014, 21 pages.
Notice of Allowance issued by the United States Patent and Trademark Office in U.S. Appl. No. 12/563,182 dated Jul. 17, 2014, 21 pages.
Notice of Defects issued from the Israeli Patent Office in corresponding Israeli Patent Application No. 193581, dated Sep. 26, 2011, total 5 pgs (including translation).
Notice of Defects issued in Israeli Application No. 228423 dated Jul. 23, 2014, 4 pages.
Notice of Opposition against EP 2508414 dated Feb. 10, 2017, *Whirlpool EMEA S.p.A.* v. *Goji Limited*, 21 pages.
Notice of Opposition against EP 2508414 dated Feb. 13, 2017, *Stefan Haas*. v. *Goji Limited*, 25 pages.
Notice of Reason for Rejection issued by the Japanese Patent Office in Japanese Application No. 2012-179718 dated Mar. 14, 2014, 7 pages.
Notice of Reason for Rejection issued by the Japanese Patent Office dated Mar. 14, 2014 in Japanese Application No. JP 2012-179718 (7 pages).
Notice of Reason for Rejection issued by the Japanese Patent Office dated Feb. 6, 2013 in corresponding Japanese Application No. JP 2011-535209, 3 pages.
Notice of Reason for Rejection dated Aug. 27, 2013 from Patent Office in related Japanese Patent Application No. 2012-179718 (7 pages).
Notice of Reason for Rejection dated Oct. 1, 2013 from Japanese Patent Office in related Japanese Patent Application No. 2012-179719 (5 pages).
Notice of the First Review Opinions dated Dec. 21, 2012 from the Chinese State Intellectual Property Office in related Chinese Application No. 200980154040.9 (11 pages).
Notice of the Reasons for Rejection dated Nov. 13, 2012 in related Korean Patent Application No. 2008-7022187 (6 pages).
Notification of Transmittal of the International Search Report dated Dec. 27, 2007 from the International Searching Authority by the Patent Cooperation Treaty Re: Application No. PCT/IL2007/000864.

(56) References Cited

OTHER PUBLICATIONS

Office Action issued by the Japanese Patent Office in Japanese Application No. 2012-179718 dated Mar. 14, 2014.
Office Action issued by the United States Patent and Trademark Office in U.S. Appl. No. 12/563,180 dated Aug. 28, 2013, 23 pages.
Office Action issued by the United States Patent and Trademark Office in U.S. Appl. No. 12/309,173 dated Aug. 13, 2012, 12 pages.
Office Action issued by the United States Patent and Trademark Office in U.S. Appl. No. 12/457,154 dated Sep. 12, 2012, 9 pages.
Office Action issued by the United States Patent and Trademark Office in U.S. Appl. No. 12/906,604 dated Jun. 25, 2012, 7 pages.
Office Action issued by the United States Patent and Trademark Office in U.S. Appl. No. 12/906,604 dated Nov. 15, 2012, 7 pages.
Office Action issued by the United States Patent and Trademark Office in U.S. Appl. No. 12/899,348 dated Jun. 27, 2014, 10 pages.
Office Action issued by the United States Patent and Trademark Office in U.S. Appl. No. 12/563,180, dated Dec. 27, 2012 (18 pages).
Office Action issued by the United States Patent and Trademark Office in U.S. Appl. No. 12/563,180, dated Jun. 4, 2013 (21 pages).
Office Action issued by the United States Patent and Trademark Office in U.S. Appl. No. 12/563,182, dated Oct. 4, 2012 (15 pages).
Office Action issued by the United States Patent and Trademark Office in U.S. Appl. No. 12/899,348, dated Jul. 31, 2012 (11 pages).
Office Action issued by the United States Patent and Trademark Office in U.S. Appl. No. 12/899,348, dated Sep. 21, 2012 (14 pages).
Office Action issued by the United States Patent and Trademark Office in U.S. Appl. No. 12/907,663, dated Aug. 29, 2012 (26 pages).
Office Action issued by the United States Patent and Trademark Office in U.S. Appl. No. 12/907,663, dated Jun. 6, 2013 (20 pages).
Office Action issued by the United States Patent and Trademark Office in U.S. Appl. No. 13/464,754, dated Jun. 6, 2013 (12 pages).
Office Action issued by the United States Patent and Trademark Office in U.S. Appl. No. 12/563,182, dated Jul. 5, 2013 (20 pages).
Office Action issued by the United States Patent and Trademark Office in U.S. Appl. No. 12/899,348, dated Jul. 10, 2013 (18 pages).
Office Action issued by the United States Patent and Trademark Office in U.S. Appl. No. 12/899,348, dated Jan. 3, 2014 (29 pages).
Office Action issued by the United States Patent and Trademark Office in U.S. Appl. No. 12/563,182, dated Feb. 26, 2014 (13 pages).
Office Action issued by the United States Patent and Trademark Office in U.S. Appl. No. 12/563,180, dated Mar. 12, 2014 (22 pages).
Office Action issued by the United States Patent and Trademark Office in U.S. Appl. No. 12/563,180, dated Aug. 28, 2013 (21 pages).
Office Action issued by the United States Patent and Trademark Office in U.S. Appl. No. 12/907,663, dated Apr. 15, 2014 (23 pages).
Office Action issued in Israeli Application No. 228423 dated Jul. 23, 2014 4 pages.
Official Action dated Jun. 3, 2010 From the US Patent and Trademark Office Re.: U.S. Appl. No. 12/217,167.
Official Action dated Nov. 10, 2011 From the US Patent and Trademark Office Re.: U.S. Appl. No. 12/899,348.
Official Action dated Nov. 22, 2011 From the US Patent and Trademark Office Re.: U.S. Appl. No. 12/907,663.
Official Action dated Jun. 28, 2011 From the US Patent and Trademark Office Re.: U.S. Appl. No. 12/222,948.
Official Action dated Jul. 14, 2010 From the State IP Office, P R. China Re.: Application No. 200780014028.9. (9 pages including translations.).
Official Action dated Nov. 10, 2011 From the US Patent and Trademark Office Re.: U.S. Appl. No. 12/899,348. (25 pages.).
Official Office Action dated May 27, 2013 from Taiwan Patent Office in related Taiwanese U.S. Appl. No. 96/106,448, 10 pages.
Penfold et al., "Control of Thermal Runaway and Uniformity of Heating in the Electromagnetic Rewarming of a Cryopreserved Kidney Phantom", *Cryobiology*, vol. 30, pp. 493-508, 1993.
Pozar, D.M., "Chapter 4: Microwave Network analysis," *Microwave Engineering*, 2nd ed., John Wiley & Sons, Inc., pp. 190-211, 1998.
Rabinovitch, J., "New Design for the Mk Irf Finger Contacts in the LHC."
Repacholi "Radiofrequency Electromagnetic Field Exposure Standards", IEEE Engineering in Medicine and Biology Magazine, p. 18-21, Mar. 1987.
Response to the Written Opinion, dated Feb. 23, 2010, for International Application No. PCT/IL2009/000199, from the International Searching Authority.
Risco "Microwaves and Vascular Perfusion: Obtaining Very Rapid Organ Cooling", Cryobiology, 49: 294, Abstract No. 11, 2004.
Robinson et al. "Electromagnetic Re-Warming of Cryopreserved Tissues: Effect of Choice of Cryoprotectant and Sample Shape on Uniformity of Heating", Physics in Medicine and Biology, 47: 2311-2325, 2002.
Robinson et al. "Rapid Electromagnetic Warming of Cells and Tissues", IEEE Transactions on Biomedical Engineering, 46(12): 1413-1425, Dec. 1999.
Rocha, A. M. et al., "Optimization of a door seal structure of a microwave oven using a FDTD method," *International Journal of Numerical Modeling: Electronic Networks, Devices and Fields*, Int. J. Numer. Model. 2008; 21:507-513, Jul. 21, 2008.
Schwan et al. "RF-Field Interactions With Biological Systems: Electrical Properties and Biophysical Mechanisms", Proceedings of the IEEE, 68(1): 104-113, Jan. 1980.
Scott "Understanding Microwaves", A Wiley-Interscience Publication, 1: 326-331, 1993.
Search Report dated May 9, 2013 in related Taiwanese Patent Application No. 096106448, 1 page.
Second Office Action dated Jan. 5, 2012 from the Chinese State Intellectual Property Office in related Chinese Application No. 200780014028.9 (3 pages).
Shelley, "Inside View on Deep Heat," Eureka Innovative Engineering Design, 2 P., May 14, 2007.
Sherman et al. "A New Rapid Method for Thawing Fresh Frozen Plasma", Transfusion, 14(6): 595-597, Nov.-Dec. 1974.
Söhngen et al., "Thawing of Fresh-Frozen Plasma With A New Microwave Oven," *Transfusion*, vol. 28, No. 6, pp. 576-580,1988.
Submission of Response by Stefan Haas dated Jan. 4, 2019, Ref. P55775EP2 in corresponding European Application No./Patent No. 12165499.0-1204 / 2528414 (11 pages).
Submission of Response by Whirlpool EMEA S.p.A. dated Jan. 8, 2019, Ref. P55775EP2 in corresponding European Application No./Patent No. 12165499.0-1204 / 2528414 (16 pages).
Summons and Annex to Oral Proceedings dated Sep. 19, 2012, in related European Patent Application No. 07 706 172.9 (6 pages).
Summons to attend oral proceedings pursuant to Rule 115(1) EPC issued by the European Patent Office in EP 07706172.9, dated Sep. 19, 2012, 6 pages.
Swain et al., "What is the most energy efficient method of cooking a 'British' roast dinner?," *University of Bristol Fryers Research Project*, Feb. 29, 2008.
Third Office Action dated Aug. 8, 2012 from the Chinese State Intellectual Property Office in related Chinese Application No. 200780014028.9 (3 pages).
Tomiyasu, K., "Minimizing Radiation Leakage from Microwave Ovens," *IEEE Microwave Magazine*, Feb. 1, 2008.
Umashankar, K. et al., "A Novel Method to Analyze Electromagnetic Scattering of Complex Objects," *IEEE Transactions on Electromagnetic Compatibility*, vol. EMC-24, No. 4, Nov. 1, 1982.
Umishita, K. et al., "Absorption and Shielding Effect of Electromagnetic Wave at GHz Frequency by Multi-walled Carbon Nanotube/Polymer Composites," *Proceedings of the 9th European Conference on Wireless Technology*, Sep. 1, 2006.
Von Hippel "Theory: A. Macroscopic Properties of Dielectrics. Comples Permittivity and Permeability", Dielectric Materials and Applications, 1: 3-5, 1995.
Walker et al. "Fractal Volume Antennas", Electronics Letters, 34(16): 1536-1537, Aug. 6, 1998.
Written Opinion dated Nov. 13, 2008 From the International Searching Authority Re.: Application No. PCT/IL2008/000231.

(56) References Cited

OTHER PUBLICATIONS

Written Opinion dated May 20, 2008 From the International Searching Authority Re.: Application No. PCT/IL2007/001073.
Written Opinion dated Dec. 27, 2007 From the International Searching Authority Re.: Application No. PCT/IL2007/000864.
Written Opinion dated Aug. 31, 2007 From the International Searching Authority Re.: Application No. PCT/IL2007/000236.
Wusteman et al., "Vitrification of Large Tissues With Dielectric Warming: Biological Problems and Some Approaches to Their Solution," *Cryobiology*, vol. 48, pp. 179-189, 2004.
Interlocutory Decision dated Apr. 11, 2019, Ref. P55775EP2 in corresponding European Application No./Patent No. 12165499.0-1204/2528414 (51 pages).
Notice of Opposition from the European Patent Office, Ref. P55775EP3, Application No. 15192062.6-1202, EP Patent No. 3010309, 72 pages, dated Jan. 15, 2020.
Communication of Notice of Opposition from the European Patent Office, Request to File Opposition Observations, Ref. P55775EP3, Application No. 15192062.6-1202, EP Patent No. 3010309, 1 page, dated Jan. 24, 2020.
Adams "Microwave Blood Plasma Defroster", Journal of Microwave Power and Electromagnetic Energy, 26(3): 156-159, 1991.
Arens et al. "Danger of Overwarming Blood by Microwave", JAMA, 218(7): 1045-1046, 718, Nov. 15, 1971.
Bird "Antenna Feeds", Encyclopedia of RF and Microwave Engineering, p. 185-217, 2005.
Bows, J.R., "Variable Frequency Microwave Heating of Food", Journal of Microwave Power and Electromagnetic Energy 34(4), 1999, pp. 227-238.
Boström et al. "Rapid Thawing of Fresh-Frozen Plasma With Radio Wave-Based Thawing Technology and Effects on Coagulation Factors During Prolonged Storage at 4° C.", Vox Sanguinis, 97: 34-38, 2009.
Collin "Electromagnetic Theory: Wave Equation", Foundations for Microwave Engineering, IEEE Press Series on Electromagnetic Wave Theory, 2nd Ed., Chap.2.4: 31-32, 2001.
Collin "Transmission Lines and Waveguides", Foundations for Microwave Engineering, IEEE Press Series on Electromagnetic Wave Theory, 2nd Ed., p. 96-99, 2001.
Collin, R.E., "Chapter 4: Circuit Theory for Waveguiding Systems," *Foundations of Microwave Engineering*. 2nd ed. IEEE Press Series on electromagnetic wave theory, pp. 233-254, 2001.
Kim, J. et al., "Novel Microstrip-to-Stripline Transitions for Leakage Suppression in Multilayer Microwave Circuits," Proceedings of IEEE 7th topical Meeting on Electrical Performance of Electronic Packaging, pp. 252-255, Oct. 1998.
Marcroft et al. "Flow Field in s Hot Air Jet Impingement Oven—Part II: Multiple Impingement Jets", Journal of Food Processing Preservation, 23: 235-248, 1999.
Summons to Oral Proceedings Pursuant to Rule 115(1) EPC from the European Patent Office, Ref. P55775EP2, Application No. 12165499.0 / Patent No. 2528414, 16 pages, dated Oct. 27, 2021.

* cited by examiner

SYSTEM AND METHOD FOR APPLYING ELECTROMAGNETIC ENERGY

This application is a continuation of U.S. patent application Ser. No. 13/080,072, filed on Apr. 5, 2011, which is a continuation-in-part of U.S. patent application Ser. No. 12/222,948, which was filed on Aug. 20, 2008, now U.S. Pat. No. 8,207,479, issued on Jun. 26, 2012, as a continuation of International Application No. PCT/IL07/00236, filed Feb. 21, 2007, which claims priority to U.S. Provisional Patent Application No. 60/775,231, filed Feb. 21, 2006, and also to U.S. Provisional Patent Application No. 60/806,860, filed Jul. 10, 2006. This application also claims priority to U.S. Provisional Patent Application No. 61/322,133, which was filed on Apr. 8, 2010. This application is related to U.S. patent application Ser. Nos. 12/563,180 and 12/563,182, filed Sep. 12, 2009, both of which are continuations of U.S. application Ser. No. 12/222,948, filed Aug. 20, 2008. The disclosures of U.S. patent application Ser. Nos. 12/563,180 and 12/563,182, U.S. Provisional Patent Application Nos. 60/775,231, 60/806,860, and 61/322,133 and also International Application No. PCT/IL07/00236 are fully incorporated herein by reference.

BACKGROUND

Technical Field

Electromagnetic waves have been used in various applications to apply energy to objects. In the case of radio frequency (RF) for example, electromagnetic energy may be supplied using a magnetron, which is typically tuned to a single frequency for applying electromagnetic energy only in that frequency. One example of a commonly used electromagnetic device is a microwave oven. Typical microwave ovens apply electromagnetic energy at the single frequency of 2.45 GHz. To increase the distribution of electromagnetic waves, the typical microwave oven includes a metallic fan (behind a grill in the oven) to disturb the standing wave pattern and in an attempt to achieve more uniform energy distribution in the oven's cavity.

Due to the nature of the absorptive properties of electromagnetic energy, even if uniform electromagnetic field distribution could be achieved at a particular frequency, energy absorption might not be uniform. This is because differing materials (or materials having varying characteristics) typically have variable absorptive properties. Moreover, absorptive properties are often a function of temperature and/or phase of the materials in the object. Thus, as the temperature and/or phase of an object changes, e.g., due to electromagnetic energy application, the object's absorptive properties may change, and the rate and magnitude of this change may depend on properties of material(s) in the object and the amount of energy required causing those changes. In addition, the shape of an object may contribute to its absorptive properties at a particular frequency. Irregularly shaped objects, for example, may exhibit irregular electromagnetic energy absorption. All these factors can make it difficult to control the absorption of electromagnetic energy in an object.

SUMMARY OF A FEW EXEMPLARY ASPECTS OF THE DISCLOSURE

Some exemplary aspects of the disclosure include apparatuses and methods for applying electromagnetic energy to an object in an energy application zone. Electromagnetic energy may be supplied to the zone and received via the zone. This can occur, for example, through the use of a radiating element that receives electromagnetic energy from a source and transmits it through one or more radiating elements, (e.g., antennas). An exemplary apparatus and method may further include the determination of a value indicative of energy absorbable absorption by the object at each of a plurality of frequencies. This may occur, for example, through the use of a controller, which may be further configured to cause energy to be supplied to at least one radiating element in at least a subset of the plurality of frequencies. Energy applied to the zone at each of the subset of frequencies may be a function of the absorbable energy value at each frequency. Alternatively or additionally, energy applied to the zone at each of the subset of frequencies may be a function of the absorbable energy value at more than one of the plurality of frequencies.

According to another exemplary aspect of the disclosure, one or more apparatuses or method may include determining a value indicative of energy absorbable by an object at each of a plurality of frequencies, and causing energy to be supplied to the at least one radiating element in at least a subset of the plurality of frequencies to an energy application zone. Energy applied to the zone at each of the subset of frequencies may be inversely related to the absorbable energy value at each frequency.

In yet another aspect, one or more apparatuses or methods may adjust energy supplied to the radiating element(s) as a function of the frequency at which the energy is absorbed.

Alternatively, or additionally, exemplary apparatuses and methods may determine a desired energy absorption amount in the object to be heated at each of a plurality of frequencies, and may adjust energy supplied at each frequency in order to target the desired energy absorption amount to the object to be heated at each frequency. Alternatively, or additionally, exemplary apparatuses and methods may determine a desired energy absorption amount in the object to be heated, and may adjust energy supplied at each frequency in order to target or effect substantially the desired energy absorption amount in the object to be heated.

According to a further exemplary aspect, one or more apparatuses or methods may involve determining a value indicative of energy absorbable by the object at each of a plurality of frequencies, and may further adjust energy supplied such that when the energy supplied is plotted against an absorbable energy value over a range of frequencies, the two plots tend to mirror each other.

In some embodiments, the two plots may tend to mirror each other at one or more sub-sets (e.g., sub-band) of the plurality of frequencies.

According to a further exemplary aspect, one or more apparatuses or methods may involve determining a threshold value for the value indicative of energy absorbable at at least one frequency, among the plurality of frequencies, and preventing electromagnetic energy from being supplied to the at least one radiating element at the at least one frequency.

The drawings and detailed description which follow contain numerous alternative examples consistent with embodiments of the invention. A summary of every feature disclosed is beyond the object of this summary section. For a more detailed description of exemplary aspects of the invention, reference should be made to the drawings, detailed description, and claims, which are incorporated into this summary by reference.

DETAILED DESCRIPTION

Figure 1:
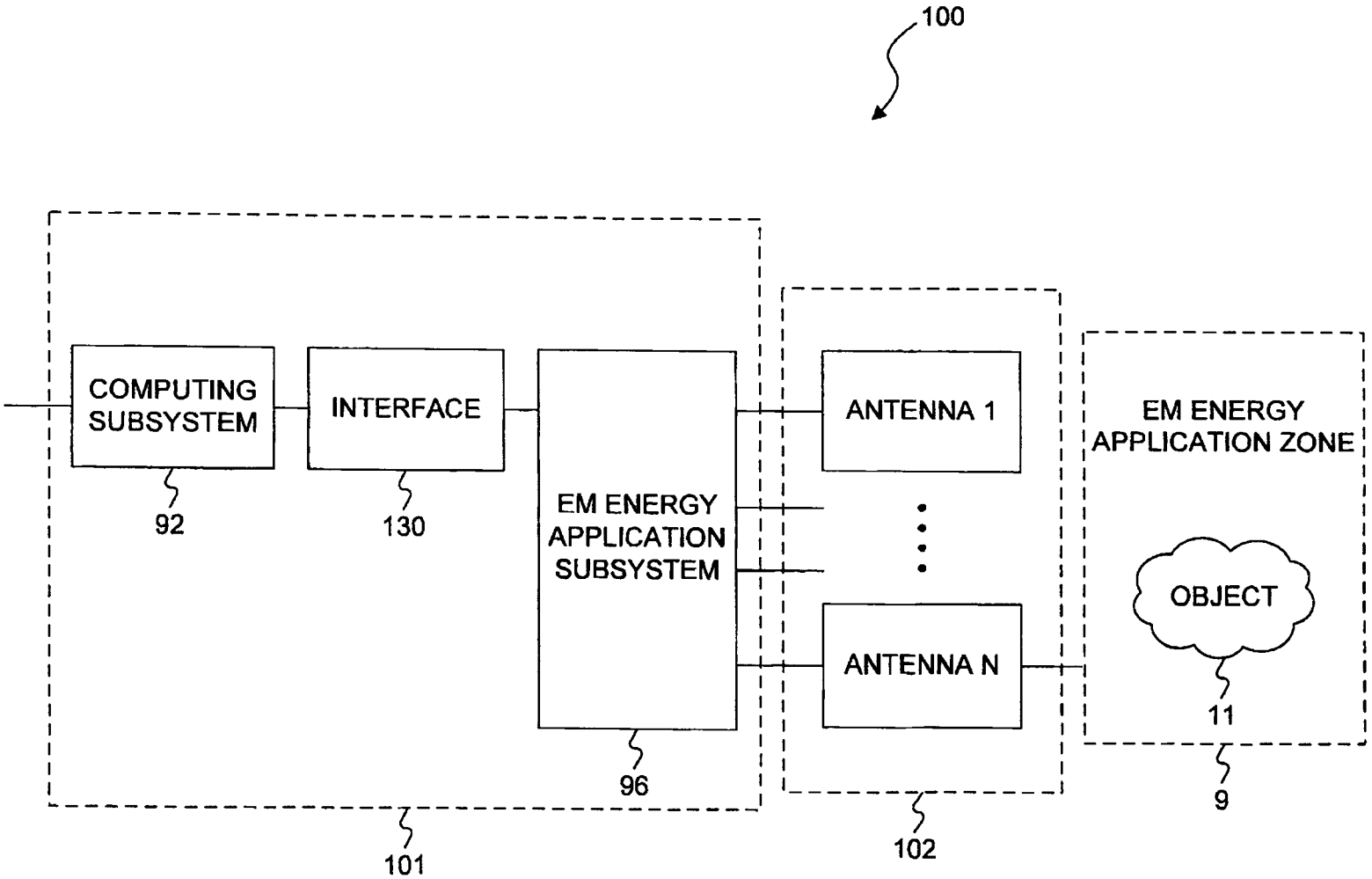
FIG. 1 is a schematic diagram of an apparatus for applying electromagnetic energy to an object, in accordance with some exemplary embodiments of the present invention.

Reference will now be made in detail to exemplary embodiments of the invention, examples of which are illustrated in the accompanying drawings. When appropriate, the same reference numbers are used throughout the drawings to refer to the same or like parts.

In one respect, the invention may involve apparatus and methods for applying electromagnetic energy. The term electromagnetic energy, as used herein, includes any or all portions of the electromagnetic spectrum, including but not limited to, radio frequency (RF), infrared (IR), near infrared, visible light, ultraviolet, etc. In one particular example, applied electromagnetic energy may include RF energy with a wavelength in free space of 100 km to 1 mm, which is a frequency of 3 KHz to 300 GHz, respectively. In some other examples, the frequency bands may be between 500 MHz to 1500 MHz or between 700 MHz to 1200 MHz or between 800 MHz tol GHz. Microwave and ultra high frequency (UHF) energy, for example, are both within the RF range. Even though examples of the invention are described herein in connection with the application of RF energy, these descriptions are provided to illustrate a few exemplary principles of the invention, and are not intended to limit the invention to any particular portion of the electromagnetic spectrum.

Similarly, for exemplary purposes, this disclosure contains a number of examples of electromagnetic energy used for heating. Again, these descriptions are provided to illustrate exemplary principles of the invention. The invention, as described and claimed, may benefit various industrial, commercial, and consumer processes involving the application of energy, regardless of whether the application of energy results in heating. For example, electromagnetic energy may also be applied to an object for combusting, thawing, defrosting, cooking, drying, accelerating reactions, expanding, evaporating, fusing, causing or altering biologic processes, medical treatments, preventing freezing or cooling, maintaining the object within a desired temperature range, or any other application where it is desirable to apply energy. Electromagnetic energy may be applied to the object to, among other things, cause portions of the object to undergo a phase change and/or volume change and/or initiated chemical reaction or reactions.

In certain embodiments, electromagnetic energy may be applied to an "object". References to an "object" (also known as a "load" or "object to be heated") to which electromagnetic energy is applied is not limited to a particular form. An "object" or a "load" may include a liquid, solid, or gas, depending upon the particular process with which the invention is utilized. The object may also include composites or mixtures of matter in differing phases. Thus, by way of non-limiting example, the term "object" encompasses such matter as food to be defrosted or cooked; clothes or other wet material to be dried; frozen organs to be thawed; chemicals to be reacted; fuel or other combustible material to be to be combusted; hydrated material to be dehydrated, gases to be expanded; liquids to be heated, boiled or vaporized, or any other material for which there is a desire to apply, even nominally, electromagnetic energy.

In some aspects, the object may comprises a plurality of "items" (also known as: portions, regions, sub-regions, areas, parts, or pieces) that may be placed together in the energy application zone. The items may be from substantially the same kind of different from each other. It is to be understood that electromagnetic energy is considered "applied to the object" if the electromagnetic energy is applied to at least one of the items (e.g., one portion) in the object.

Regardless of the form of the object, the invention may involve the application of energy to the object when the object is in the energy application zone. It is to be understood that the object need not be completely located in the energy application zone. That is, it is to be understood that an object is considered "in" the energy application zone if at least a portion of the object is located in the zone or if some portion of the object receives applied electromagnetic radiation.

By way of example only, electromagnetic energy may be applied to an object for heating, combusting, thawing, defrosting, cooking, drying, accelerating reactions, expanding, evaporating, fusing, causing or altering biologic processes, medical treatments, preventing freezing, maintaining the object within a desired temperature range, or any other application where it is desirable to apply energy.

In certain embodiments, the application of electromagnetic energy may occur in an "energy application zone", such as energy application zone 9, schematically depicted in FIG. 1. Such an energy application zone may be any void, location, region, or area where electromagnetic energy may be applied. It may include a hollow, or may be filled or partially filled with liquids, solids, gases, or combinations thereof. By way of example only, zone 9 may include an interior of an enclosure, interior of a partial enclosure, open space, solid, or partial solid that allows existence, propagation, evanescent and/or resonance of electromagnetic waves. For purposes of this disclosure, all such energy application zones may alternatively be referred to as cavities.

FIG. 1 is a diagrammatic representation of an apparatus 100 for applying electromagnetic energy to an object. Apparatus 100 may include a controller 101, an array of antennas 102 including one or more antennas, and an energy application zone 9. Controller 101 may include a computing subsystem 92, an interface 130, and an electromagnetic energy application subsystem 96. Based on an output of computing subsystem 92, energy application subsystem 96 may respond by generating one or more radio frequency signals to be supplied to antennas 102. In turn, the one or more antennas 102 may apply (e.g., radiate) electromagnetic energy into energy application zone 9. In certain embodiments, this energy can interact with an object 11 positioned within energy application zone 9.

Exemplary energy application zone 9 may include locations where energy is applied in an oven, chamber, tank, dryer, thawer, dehydrator, reactor, furnace, engine, chemical or biological processing apparatus, incinerator, material shaping or forming apparatus, conveyor, combustion zone, cooler, freezer, etc. In some embodiments, the energy application zone may be part of a vending machine, in which objects are processed once purchased. Thus, consistent with the presently disclosed embodiments, energy application zone 9 may include an electromagnetic resonator 10 (also known as cavity resonator, or cavity) (FIG. 2). At times, energy application zone 9 may be congruent with the object or a portion of the object (e.g., the object or a portion thereof, is or may define the energy application zone).

FIGS. 2A-2D show respective sectional views of a cavity 10, which is one exemplary embodiment of energy application zone 9. Cavity 10 may be cylindrical in shape and may be made of a conductor, for example, aluminum, stainless steel or any suitable metal or other conductive material. Cavity 10 may be resonant in a predetermined range of frequencies (e.g., the UHF or microwave range of frequencies, for example, between 300 MHz and 3 GHz, or between 400 MHz and 1 GHZ). It is contemplated that cavity 10 may be of any other suitable shapes including semi-cylindrical, spherical, hemispherical, rectangular, elliptical, cuboid etc. In the presently disclosed embodiments, cavity 10 may even be of an irregular, symmetrical or asymmetrical shape. It is also contemplated that cavity 10 may be closed, i.e., completely enclosed (e.g., by conductor materials), bounded at least partially, or open, i.e., having non-bounded openings. The general methodology of the invention is not limited to any particular cavity shape or configuration, as discussed earlier.

In certain embodiments, the application of electromagnetic energy may occur via one or more power feeds. A feed may include one or more waveguides and/or one or more radiating elements (e.g., antennas) for applying electromagnetic energy to the zone. Alternatively, a feed may include any other suitable structure from which electromagnetic energy may be emitted.

In the presently disclosed embodiments, more than one feed and plurality of radiating elements may be provided. The radiating elements may be located on one or more surfaces of the energy application zone. Alternatively, radiating elements may be located inside or outside the energy application zone. The orientation and configuration of each radiating element may be distinct or the same, based on the specific energy application. For example, each radiating element may be positioned, adjusted, and/or oriented to transmit electromagnetic waves along a same direction, or various different directions. Furthermore, the location, orientation, and configuration of each radiating element may be predetermined before applying energy to the object, or dynamically adjusted using a processor while applying energy. Moreover, the location, orientation, and configuration of each radiating element may be dynamically adjusted, for example, using a processor during operation of the apparatus, between rounds of energy application. The invention is not limited to radiating elements having particular structures or which are necessarily located in particular areas or regions.

As schematically depicted in the block diagram of FIG. 1, apparatus 100 may include at least one radiating element in the form of at least one antenna 102 for applying electromagnetic energy to the energy application zone 9. The antenna may also be configured to receive electromagnetic energy via the zone. In other words, an antenna, as used herein may function as a transmitter, a receiver, or both, depending on particular application and configuration. When an antenna acts as a receiver for electromagnetic energy from an energy application zone (e.g., reflect electromagnetic waves), the antenna is said to receive electromagnetic energy via the zone.

As used herein, the terms "radiating element" and "antenna" may broadly refer to any structure from which electromagnetic energy may radiate and/or be received, regardless of whether the structure was originally designed for the purposes of radiating or receiving energy, and regardless of whether the structure serves any additional function. For example, a radiating element or an antenna may include an aperture/slot antenna, or an antenna which includes a plurality of terminals transmitting in unison, either at the same time or at a controlled dynamic phase difference (e.g., a phased array antenna). Consistent with some exemplary embodiments, antennas 102 may include an electromagnetic energy transmitter (referred to herein as "a transmitting antenna") that feeds energy into electromagnetic energy application zone 9, an electromagnetic energy receiver (referred herein as "a receiving antenna") that receives energy from zone 9, or a combination of both a transmitter and a receiver. For example, a first antenna may be configured to supply (or apply) electromagnetic energy to zone 9, and a second antenna may be configured to receive energy from the first antenna. Alternatively, multiple antennas may each serve as both receivers and transmitters, and some antennas may serve a dual function while others serve a single function. So, for example, a single antenna may be configured to both apply electromagnetic energy to the zone 9 and to receive electromagnetic energy via the zone 9; a first antenna may be configured to apply electromagnetic energy to the zone 9 and a second antenna may be configured to receive electromagnetic energy via the zone 9; or a plurality of antennas could be used, where at least one of the plurality of antennas is configured to both apply electromagnetic energy to zone 9 and to receive electromagnetic energy via zone 9. At times, in addition to or as an alternative to applying and/or receiving energy, an antenna may also be adjusted to affect the field pattern. For example, various properties of the antenna, for example, position, location, orientation, temperature, etc., may be adjusted. Different antenna property settings may result in differing electromagnetic field patterns within the energy application zone thereby affecting energy absorption in the object. Therefore, antenna adjustments may constitute one or more variables that can be varied in an energy application process.

Consistent with some embodiments, energy may be supplied to one or more transmitting antennas. Energy supplied to a transmitting antenna may result in energy emitted by the transmitting antenna (referred to herein as "incident energy"). The incident energy may be applied to zone 9, and may be in an amount equal to the one that is supplied to the antennas by a source. Of the incident energy, a portion may be dissipated by the object (referred to herein as "dissipated energy" or "absorbed energy"; the terms dissipated or dissipation are interchangeable with absorbed or absorption). Another portion may be reflected at the transmitting antenna (referred to herein as "reflected energy"). Reflected energy may include, for example, energy reflected back to the transmitting antenna due to mismatch caused by the object and/or the energy application zone. Reflected energy may also include energy retained by the port of the transmitting antenna (i.e., energy that is emitted by the antenna but does not flow into the zone). The rest of the incident energy, other than the reflected energy and dissipated energy may be transmitted to one or more receiving antennas other than the transmitting antenna (referred to herein as "transmitted energy."). Therefore, the incident energy ("I") supplied to the transmitting antenna may include all of the dissipated energy ("D"), reflected energy ("R"), and transmitted energy ("T"), the relationship of which may be represented mathematically as $I=D+R+\Sigma T_i$.

In accordance with certain aspects of the invention, the one or more transmitting antennas may apply electromagnetic energy into zone 9. Energy delivered by a transmitting antenna into the zone (referred to herein as "delivered energy" or "d") may be the incident energy emitted by the antenna minus the reflected energy at the same antenna. That is, the delivered energy may be the net energy that flows from the transmitting antenna to the zone, i.e., $d=I-D$. Alternatively, the delivered energy may also be represented as the sum of dissipated energy and transmitted energy, i.e., $d=R+T$, (where $T=\Sigma Ti$).

The invention is not limited to antennas having particular structures or which are necessarily located in particular areas or regions. Antennas 102 may be placed in differing locations of zone 9. Antennas 102 may be polarized in differing directions in order to, for example, reduce coupling, enhance specific field pattern(s), increase the energy application efficiency, support specific algorithm(s), and in the presently disclosed embodiments, enable the application of specific algorithm. The foregoing are examples only, and polarization may be used for other purposes as well. In one example, three antennas may be placed parallel to orthogonal coordinates, however it is contemplated that any suitable number of antennas (for example, one, two, three, four, five, six, seven, eight, etc.) may be used. For example, a higher number of antennas may add flexibility in system design and improve control of energy distribution, e.g., greater uniformity and/or resolution of energy application in zone 9 (i.e., the ability to differentiate one region in the zone from another region and apply differing controllable amounts of energy to two different regions). Alternatively, other aspects of the invention may contribute to uniformity of energy application.

FIGS. 2A-2D show antennas (16, 18 and 20) as examples of antennas 102 shown in FIG. 1. As shown in FIGS. 2A-2D, antenna 16 may be positioned on a bottom end 12 of a cylinder, and antennas 18 and 20 may be located in spaced apart relationship on the cylinder side wall 14. Antennas 16, 18, and 20 may be configured to feed energy at a frequency which is optionally chosen by controller 101, as is discussed later in greater detail. In some exemplary embodiments, one or more field adjusting elements 22, 24 may be placed inside cavity 10, optionally near antennas 16, 18, and 20. It is contemplated that field adjusting elements 22 and 24 may be made in shapes and materials other than the two exemplary ones shown in FIGS. 2A-2D.

Consistent with some embodiments, field adjusting elements 22 and 24 may be adjusted to change the electromagnetic wave pattern in cavity 10 in a way that selectively directs the electromagnetic energy from antennas 16, 18, and 20 into object 11. Additionally or alternatively, field adjusting elements 22 and 24 may be further adjusted to simultaneously match at least one of antennas 16, 18, and 20 that act as transmitters, and thus reduce coupling to the other antennas that act as receivers.

Figure 2A:
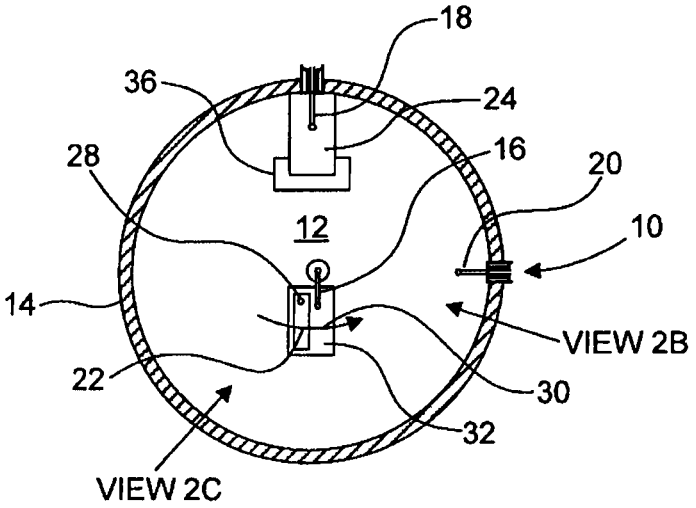
FIGS. 2A, 2B, 2C, and 2D are various views of a cavity, in accordance with some exemplary embodiments of the present invention.
Figure 2B:
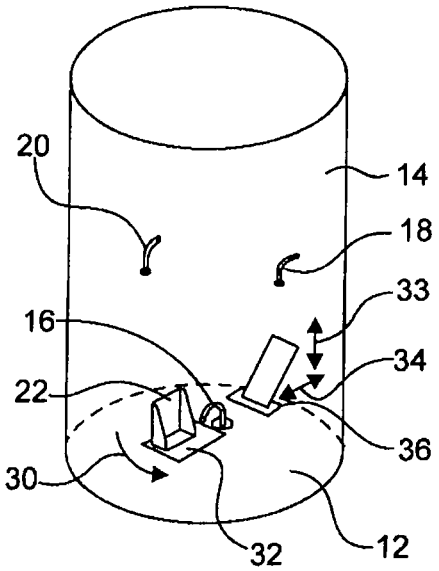
Figure 2C:
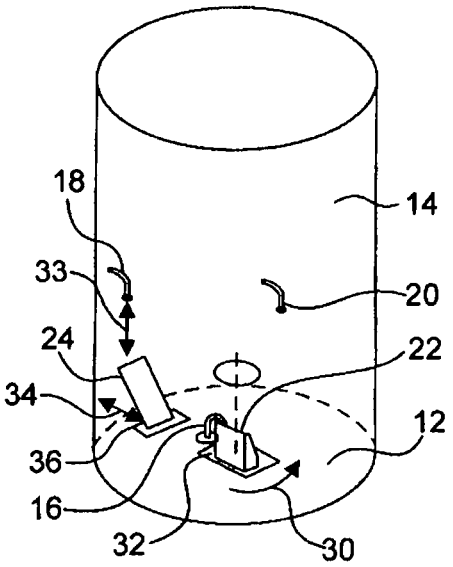
Figure 2D:
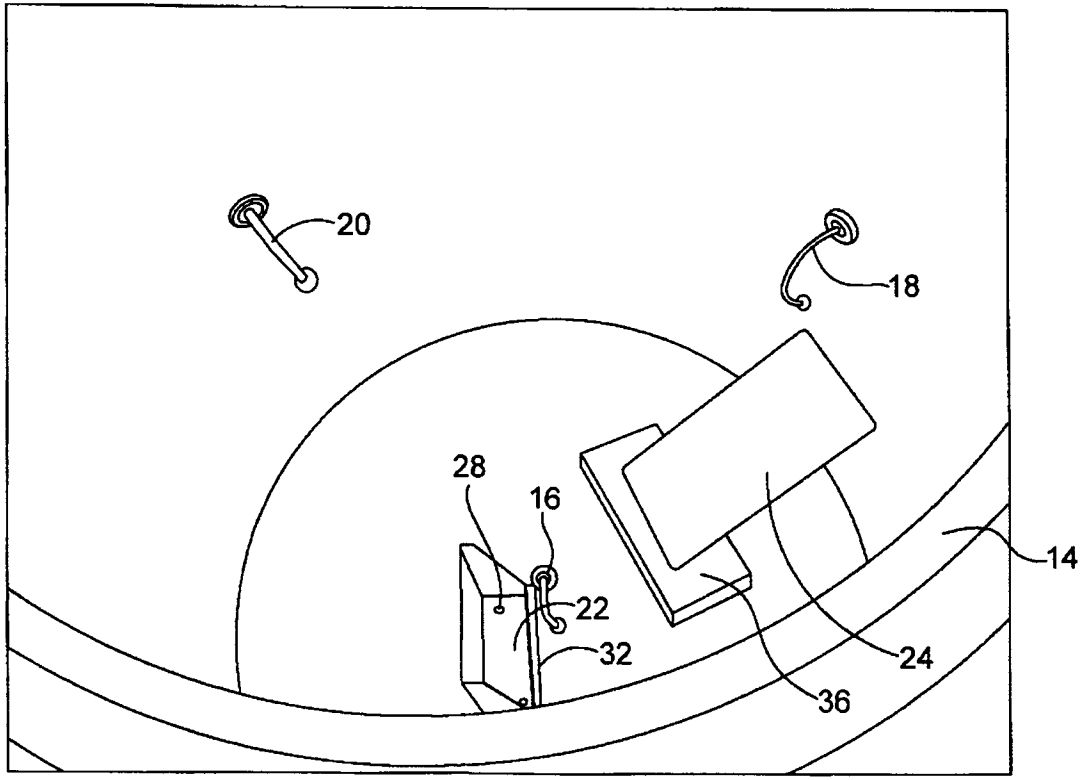
Figure 3A:
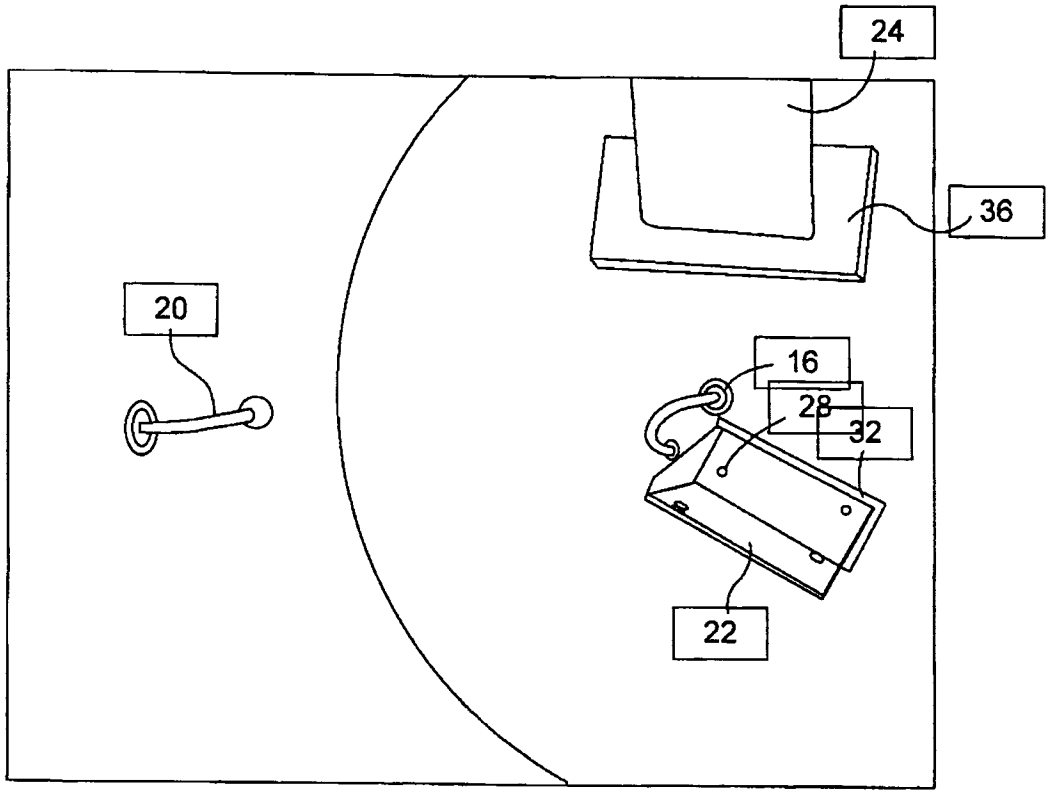
FIGS. 3A and 3B are enlarged views of field adjusting elements such as those illustrated in FIGS. 2A-2D.

Field adjusting element 22, as shown, for example, in FIGS. 2A, 2B and 3A, may be situated on bottom end 12 of cavity 10. Element 22 may be rotatable in a direction 30 about an axis 28 on cylinder end 12. Consistent with some embodiments, element 22 may be insulated from the end by an insulating sheet 32 which couples element 22 capacitively to end 12. Consistent with other embodiments, element 22 may be conductively attached to end 12.

Figure 3B:
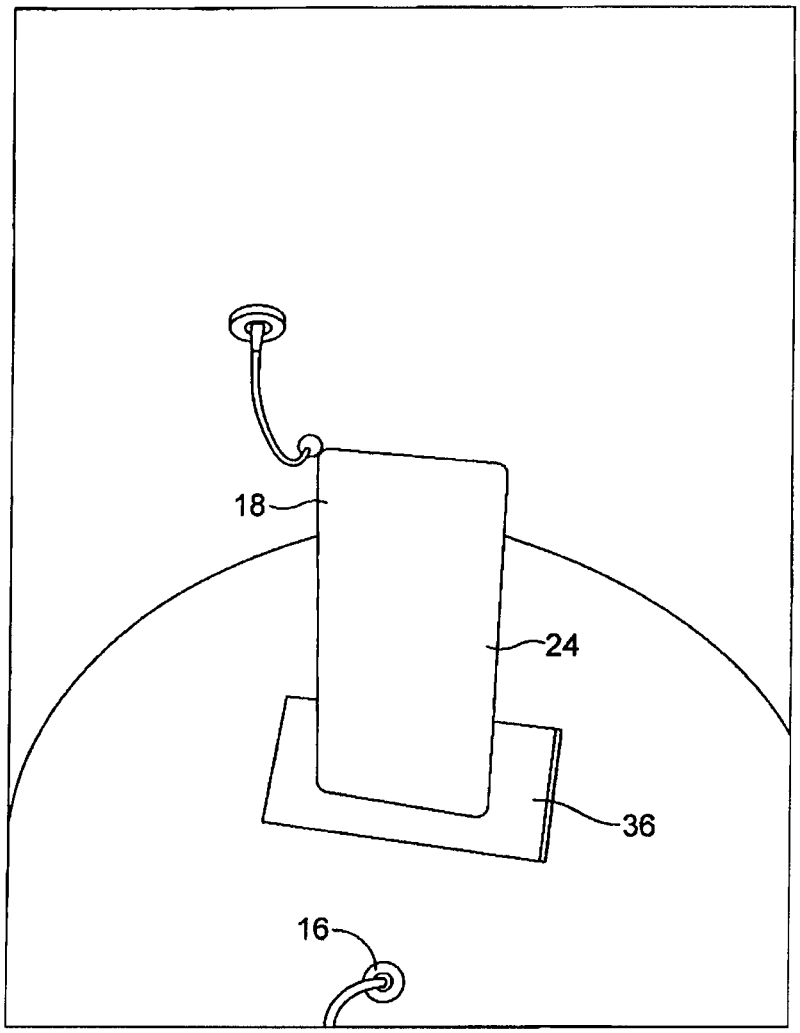

Field adjusting element 24, as shown more clearly in FIG. 3B may be situated between antenna 18 and end 12. One end of element 24 may be electrically attached to wall portion 14 of cavity 10. The other end of element 24 may be spaced and insulted from end 12 by insulating material 36. Consistent with the presently disclosed embodiments, element 24 may slide along end 12 and cylindrical portion 14 as shown by arrows 33 and 34 in FIG. 2B. The capability of sliding may change the spectral variation of the energy absorption efficiency inside cavity 10.

Additionally, one or more sensor(s) (or detector(s)) may be used to sense (or detect) information (e.g., signals) relating to object 11 and/or to the energy application process and/or the energy application zone (e.g., zone 9). At times, one or more antennas, e.g., antenna 16, 18, may be used as sensors. The sensors may be used to sense any information, including electromagnetic power, temperature, weight, humidity, motion, etc. The sensed information may be used for any purpose, including, for example, process verification, automation, authentication, safety.

FIGS. 4A-4H illustrate three exemplary embodiments of antennas 102 that may be used in apparatus 100. Consistent with some embodiments, directional and/or wideband antennas may be used to adjust an amount of electromagnetic energy emitted by the transmitting antennas that is dissipated in object 11 and also an amount of electromagnetic energy transmitted between the transmitting antennas and other receiving antennas. Such antennas may include, for example, patch antennas, fractal antennas, helix antennas, log-periodic antennas, spiral antennas, slot antennas, dipole antennas, loop antennas or any other structure capable of transmitting and/or receiving electromagnetic energy.

Consistent with the presently disclosed embodiments, antennas 102 may form an antenna array. An antenna array may occupy a larger area than a single antenna, reducing the dependence of location of an object on an energy application protocol (e.g., a heating protocol). Furthermore, an antenna array may have a higher directionality or bandwidth than individual antennas. By way of example, two or more of the antenna sources may be consistent, such that antennas 102 may have a common behavior. In another example, antenna arrays can be made steerable to provide variable antenna directionality and to allow more efficient transfer of energy to object 11.

Consistent with the presently disclosed embodiments, antennas 102 may include one or more feeds supplied with electromagnetic waves having the same or different phases reaching some or all antennas in an antenna array (e.g., phased array). For example, antennas 102 may be operated as a phased array such that energy is supplied to each of the antennas at a differing phase, thus matching the phase resulting from the geometrical design of the complex antenna and possibly changing the near field geometry of the electromagnetic field and/or concentrating the energy maxima in the object or in one or more portions of the object. A phased array may allow summing of electromagnetic energy on the object. In addition, by having the ability to control the phase of each antenna dynamically (and independently), a phased array may provide an additional degree of freedom in controlling electromagnetic wave patterns in electromagnetic energy application zone 9. Various types of feeds may be used to feed the electromagnetic energy, including main wires, cables, transmission lines, waveguides, or any other structure capable of conveying electromagnetic energy.

Figure 4A:
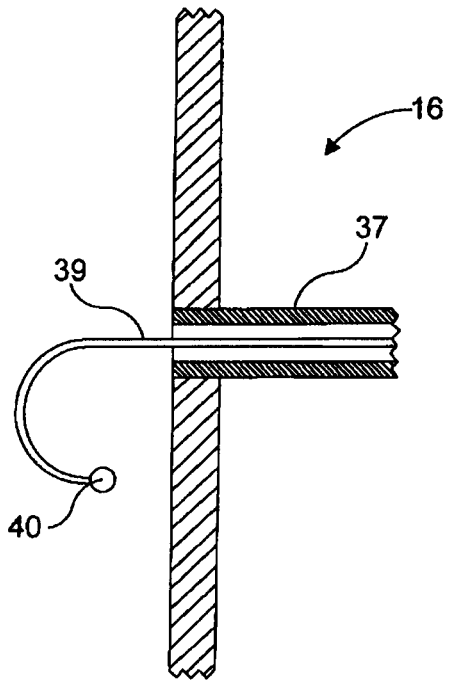
FIG. 4A is a cross-sectional view of an antenna, in accordance with some embodiments of the invention.

FIG. 4A shows an exemplary antenna 16 for delivering energy into cavity 10, in accordance with the presently disclosed embodiments. Antenna 16 may include, among other things, a coaxial feed 37 with its center conductor 39 bent and extending into cavity 10. Consistent with the presently disclosed embodiments, center conductor 39 may not touch the walls of cavity 10. The end of the center conductor 39 may be formed with a conductive element 40 to increase the antenna bandwidth. Center conductor 39 may be bent towards object 11, such that the electromagnetic energy may be transmitted directionally to improve the energy couple between antenna 16 and object 11.

Figure 4B:
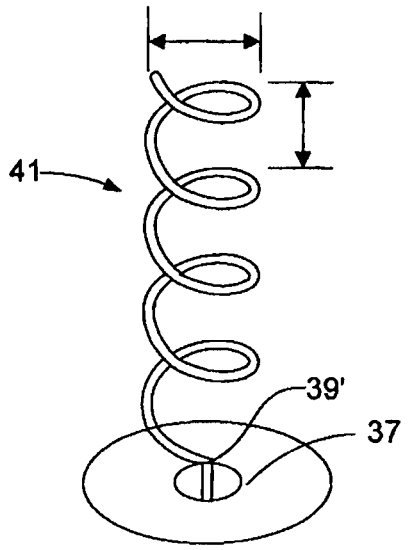
FIG. 4B is a perspective view of a helical antenna in accordance with some embodiments of the present invention.

Depending on the embodiments, the antenna structure may vary in order to tune the antenna impedance and change the electromagnetic field pattern inside cavity 10. For example, the radius and the height of a helix antenna may be adjusted. FIG. 4B shows an exemplary helix antenna 41 for delivering energy into cavity 10. Helix antenna 41 may include a coaxial feed 37 with its center conductor 39' having an extension that is formed into a helix. Helix antenna 41 may be designed to match the impedance of a system (e.g., with different loads) over a relatively wide band of frequencies. The directionality of helix antenna 41 may be adjusted by changing the number of helix turns.

Figure 4C:
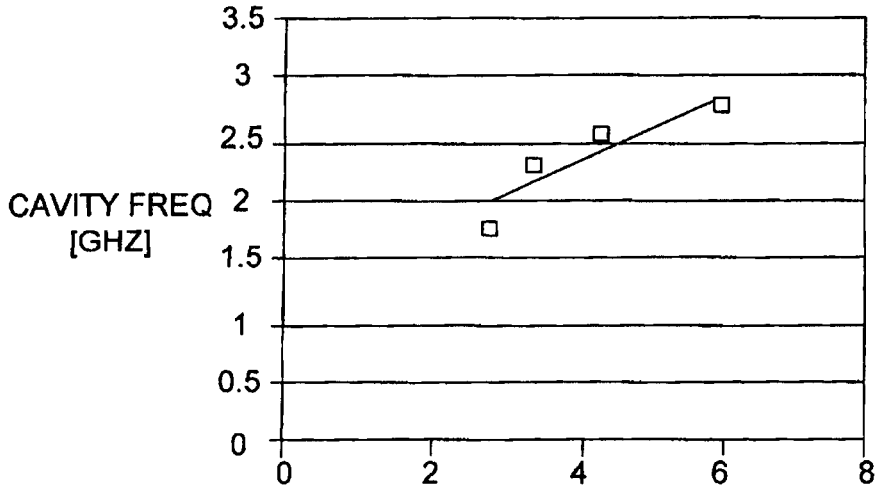
FIG. 4C is a graph of correlation of free space matched frequencies and cavity matched frequencies of the helical antenna of FIG. 4B.

FIG. 4C is a chart illustrating experimental results of an exemplary helix antenna having seven turns, a diameter equal to the free space wavelength (e.g., the wavelength of the applied electromagnetic energy) and a turn pitch of less than 0.2 wavelengths. In the chart, cavity frequency (e.g., the resonant frequency of the cavity) is plotted against free space frequency. Consistent with the presently disclosed embodiments, a free space design of helix antenna 41 may be adjusted for use inside cavity 10 based on the chart.

Figure 4D:
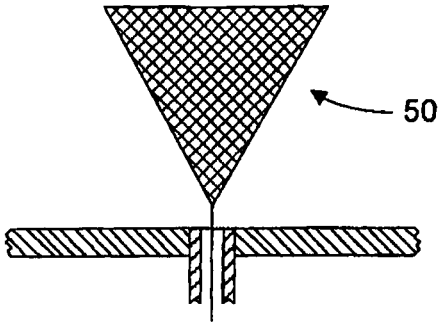
FIG. 4D-4H are partial cross-sectional side views of various fractal antenna, in accordance with embodiments of the invention.

In some embodiments, fractal antennas may be used as antennas 16, 18 and 20. FIG. 4D shows an exemplary fractal antenna: a bow-tie antenna 50 known in the art for radiation into free space. The bandwidth of the bow-tie (in free space) may be, for example, 604 MHz with a 740 MHz center frequency (−3 dB points) and 1917 MHz with a 2.84 GHz center frequency. Bow-tie antenna 50 may have a monopole, broadband directivity pattern. Such monopole directivity may irradiate in a direction other than parallel to the feed. The bandwidth of bow-tie antenna 50 may vary between 10 MHz and maximum of 70 MHz depending on the position of object 11 inside cavity.

Figure 4E:
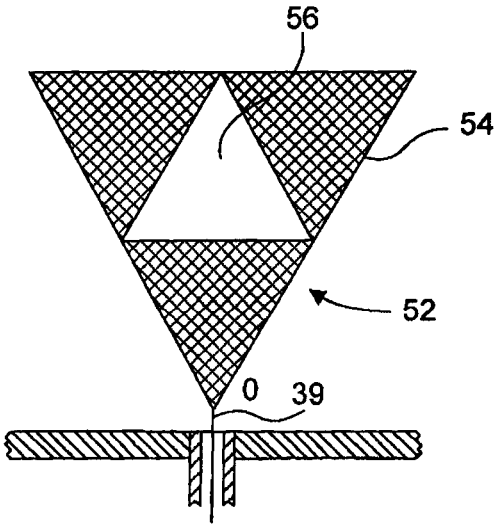
Figure 4F:
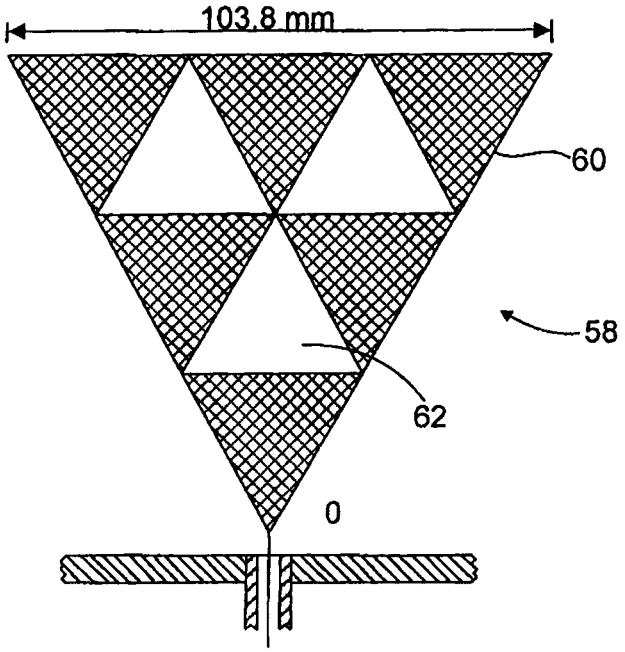
Figure 4G:
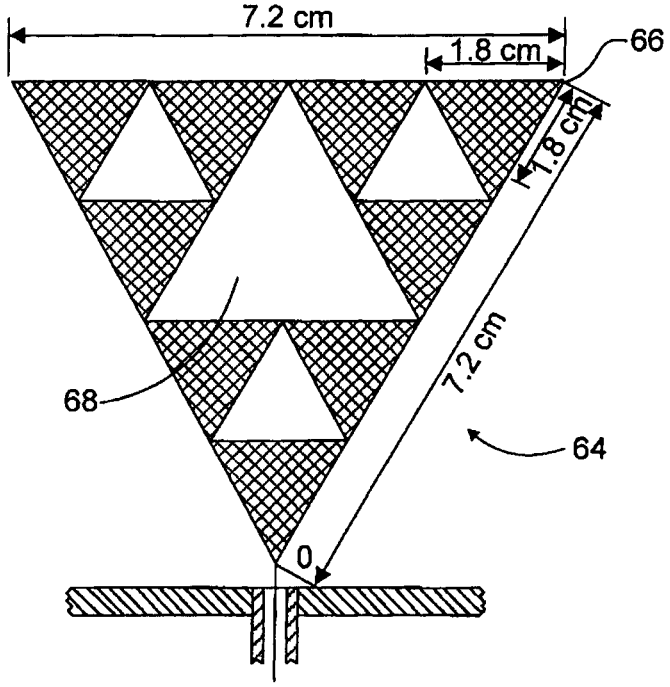

FIG. 4E shows an exemplary fractal antenna: a Sierpinski antenna 52, and FIGS. 4F and 4G illustrate two exemplary modified Sierpinski antennas 58 and 64, consistent with embodiments of the present invention. In the presently disclosed embodiments, cross-hatched areas 54, 60, and 66 may include metal plates, and white central areas 56, 62, and 68 may be non-conducting regions. The metal plates in each of FIGS. 4A-4G may be mounted on a preferably low dielectric constant dielectric and may be connected at the corners and to center conductor 39 of coaxial feed 37, as shown in FIG. 4A. Sierpinski antennas 52 and 58 may have characteristics in the cavity similar to those of bow-tie antenna 50. For example, for an overall extent of 103.8 mm utilizing equal size equilateral triangles, the center frequency of the modified Sierpinski antenna 58 may be about 600 MHz inside cavity 10. Modified Sierpinski antenna 64 may have a center frequency of 900 MHz in cavity 10.

Figure 4H:
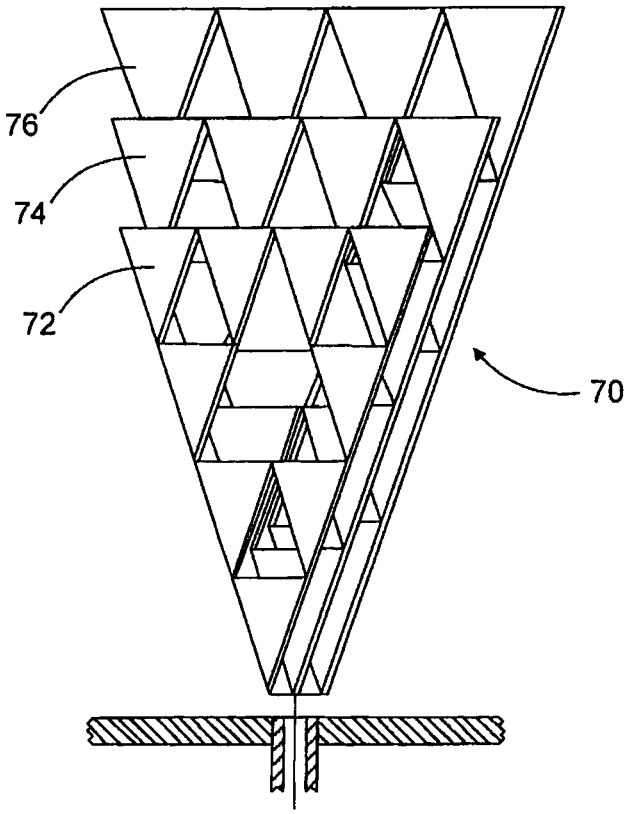

FIG. 4H shows an exemplary multi-layer fractal antenna 70 made up of three fractal antennas spaced a small distance (e.g., 2 mm) from each other. Consistent with the presently disclosed embodiments, the size of each of these antennas may be staggered in order to broaden the bandwidth of the antenna. The dimensions of a first antenna 72 may be scaled to 80% of those of the Sierpinski antenna 58 in FIG. 4F. A second antenna 74 may have the same dimensions as the Sierpinski antenna 58, and a third antenna 76 may be increased in size over second antenna 74 by a factor of 1.2. Multi-layer fractal antenna 70 may have an overall bandwidth of 100 MHz, improving over the 70 MHz maximum bandwidth of those single fractal antennas shown in FIGS. 4D-4G.

Consistent with the presently disclosed embodiments, fractal antennas may also show a center frequency change when placed in cavity 10. This difference may be used to design antennas for use in cavities by scaling the frequencies similar to FIG. 4C.

In certain embodiments, there may be provided at least one processor. As used herein, the term "processor" may include an electric circuit that performs a logic operation on input or inputs. For example, such a processor may include one or more integrated circuits, microchips, microcontrollers, microprocessors, all or part of a central processing unit (CPU), graphics processing unit (GPU), digital signal processors (DSP), field-programmable gate array (FPGA) or other circuit suitable for executing instructions or performing logic operations.

The instructions executed by the processor may, for example, be pre-loaded into the processor or may be stored in a separate memory unit such as a RAM, a ROM, a hard disk, an optical disk, a magnetic medium, a flash memory, other permanent, fixed, or volatile memory, or any other mechanism capable of storing instructions for the processor. The processor(s) may be customized for a particular use, or can be configured for general-purpose use and can perform different functions by executing different software.

If more than one processor is employed, all may be of similar construction, or they may be of differing constructions electrically connected or disconnected from each other. They may be separate circuits or integrated in a single circuit. When more than one processor is used, they may be configured to operate independently or collaboratively. They may be coupled electrically, magnetically, optically, acoustically, mechanically or by other means permitting them to interact.

The at least one processor may be configured to cause electromagnetic energy to be applied to zone 9 via one or more antennas across a series of swept frequencies, attempting to apply electromagnetic energy at each such frequency to an object 11. For example, the at least one processor may be configured to regulate one or more other components of controller 101 in order to cause the energy to be applied.

The at least one processor may be coincident with or may be part of controller 101, such as is illustrated in FIG. 1. As illustrated in FIG. 1, for example, apparatus 100 may include, controller 101 electrically coupled to one or more antennas 102. As used herein, the term "electrically coupled" refers to one or more either direct or indirect electrical connections. An indirect electrical connection may occur, for example, when the controller influences energy radiating from the antenna through one or more intermediate components. For example when a controller is connected to an antenna through one or more intermediated components, devices, circuits, or interfaces, the controller is said to be electrically coupled to the antenna indirectly. When the controller connects to the antenna without any intermediate structure, the controller is said to be electrically coupled to the antenna directly.

Controller 101 may include various components or subsystems configured to control the application of electromagnetic energy through one or more antennas 102. For example, controller 101 may include computing subsystem 92, electromagnetic energy application subsystem 96, and interface between subsystems 92 and 96. Consistent with the presently disclosed embodiments, computing subsystem 92 may be a general purpose or special purpose computer. Computing subsystem 92 may be configured to generate control signals for controlling electromagnetic energy application subsystem 96 via interface 130. Computing subsystem 92 may further receive measured signals from electromagnetic energy application subsystem 96 via interface 130. Exemplary embodiments of computing subsystem 92, electromagnetic energy application subsystem 96, and interface 130 will be described in greater details in connection with FIGS. 5A-5C, respectively.

While controller 101 is illustrated for exemplary purposes as having three subcomponents, control functions may be consolidated in fewer components, or additional components may be included consistent with the desired function and/or design of a particular embodiment. As described herein, controller 101 may be configured to perform various functions/processes for applying electromagnetic energy to zone 9.

In certain embodiments, the at least one processor may be configured to determine a value indicative of energy absorbable by the object at each of a plurality of frequencies. This may occur using one or more lookup tables, by pre-programming the processor or memory associated with the processor, and/or by testing an object in an energy application zone to determine its absorbable energy characteristics. One exemplary way to conduct such a test is through a sweep.

As used herein, the word "sweep" includes, for example, the transmission over time of more than one frequency. For example, a sweep may include the sequential transmission of multiple frequencies in a contiguous frequency band; the sequential transmission of multiple frequencies in more than one non-contiguous frequency band; the sequential transmission of individual non-contiguous frequencies; and/or the transmission of synthesized pulses having a desired frequency/power spectral content (i.e. a synthesized pulse in time). A sweep may include the transmission of frequencies in a contiguous frequency band at a predetermined frequency range, e.g., the sequential transmission of multiple frequencies in a frequency band at 0.1 MHz, 0.2 MHz, 0.5 MHz, 1 MHz or any other frequency range. Thus, during a frequency sweeping process, the at least one processor may regulate the energy supplied to the at least one antenna to sequentially apply electromagnetic energy at various frequencies to zone 9, and to receive feedback which serves as an indicator of the energy absorbable by object 11. While the invention is not limited to any particular measure of feedback indicative of energy absorption in the object, various exemplary indicative values are discussed below.

Figure 5A:
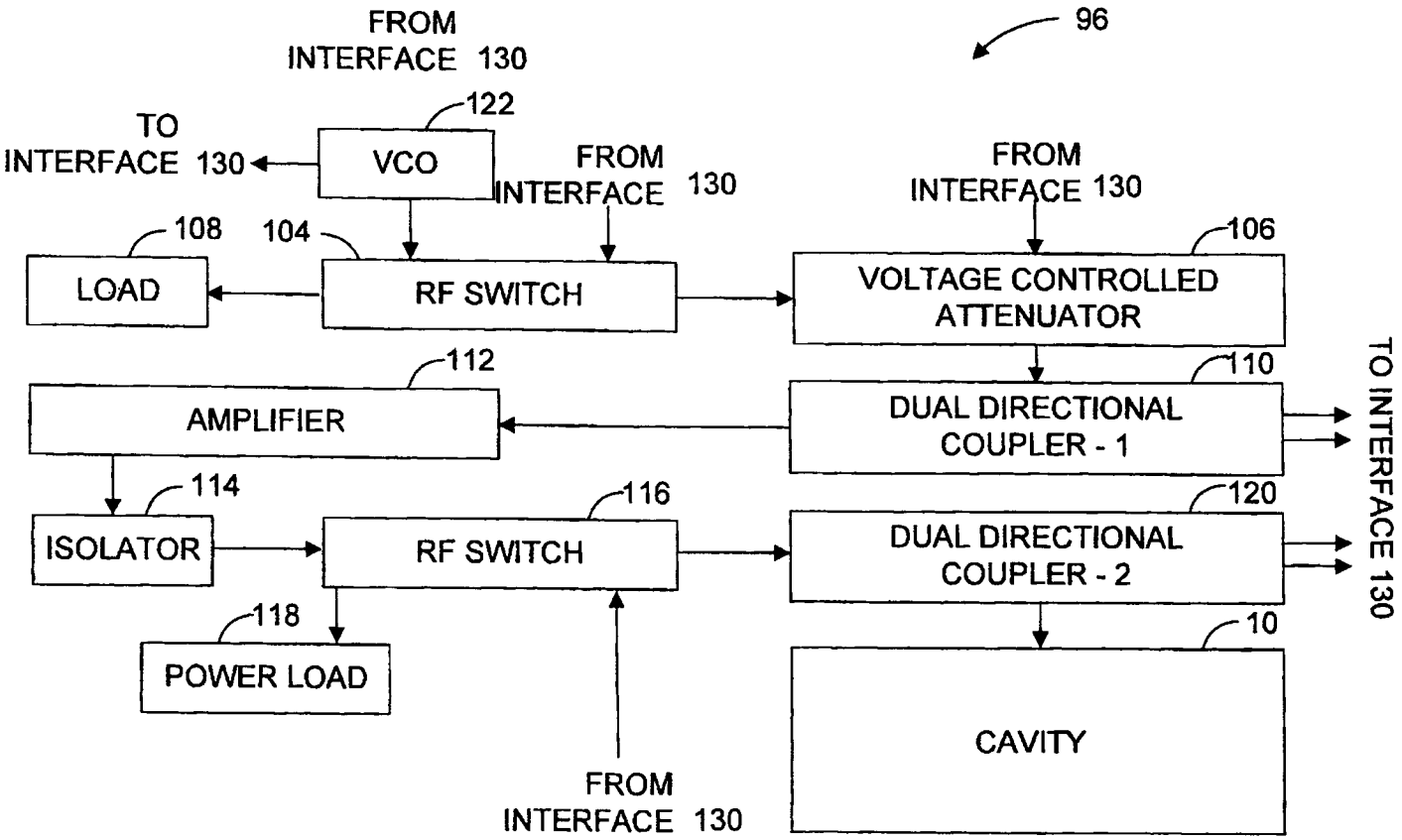
FIG. 5A is a schematic block diagrams of an exemplary electromagnetic energy application subsystem, in accordance with some embodiments of the present invention.

During the sweeping process, electromagnetic energy application subsystem 96 may be regulated to receive electromagnetic energy reflected and/or coupled at antenna(s) 102, and to communicate the measured energy information back to subsystem 92 via interface 130, as illustrated in FIG. 5A. Subsystem 92 may then be regulated to determine a value indicative of energy absorbable by object 11 at each of a plurality of frequencies based on the received information. Consistent with the presently disclosed embodiments, a value indicative of the absorbable energy may be a dissipation ratio (referred to herein interchangeably as "DR" and "dissipation ratio") associated with each of a plurality of frequencies. As referred herein, a "dissipation ratio," also known as "absorption efficiency" or "power efficiency", may be defined as a ratio between electromagnetic energy absorbed by object 11 and electromagnetic energy applied into energy application zone 9.

Energy that may be dissipated or absorbed by an object is referred to herein as "absorbable energy." Absorbable energy may be an indicator of the object's capacity to absorb energy or the ability of the apparatus to cause energy to dissipate in a given object. In the presently disclosed embodiments, absorbable energy may be calculated as a product of the maximum incident energy supplied to the at least one antenna and the dissipation ratio. Reflected energy (i.e., the energy not absorbed or transmitted) may, for example, be a value indicative of energy absorbed by the object or other load. By way of another example, a processor might calculate or estimate absorbable energy based on the portion of the incident energy that is reflected and the portion that is transmitted. That estimate or calculation may serve as a value indicative of absorbed energy.

During a frequency sweep, for example, the at least one processor may be configured to control a source of electromagnetic energy such that energy may be sequentially supplied to an object at a series of frequencies. The at least one processor may then receive a signal indicative of energy reflected at each frequency, and optionally also a signal indicative of the energy transmitted to other antennas. Using a known amount of incident energy supplied to the antenna and a known amount of energy reflected and/or transmitted (i.e., thereby indicating an amount absorbed at each frequency) an absorbable energy indicator might be calculated or estimated. Or, the processor may simply rely on an indicator of reflection as a value indicative of absorbable energy.

Absorbable energy may also include energy that may be dissipated by the structures of the energy application zone in which the object is located (e.g., cavity walls) or a leakage of energy at an interface between an oven cavity and an oven door. Because absorption in metallic or conducting material (e.g., the cavity walls or elements within the cavity) is characterized by a large quality factor (also known as a "Q factor"), such frequencies may be identified as being coupled to conducting material, and at times, a choice may be made not to apply energy in such sub bands. In that case, the amount of electromagnetic energy absorbed in the cavity walls may be substantially small, and thus, the amount of electromagnetic energy absorbed in the object may be substantially equal to the amount of absorbable energy.

The absorption of electromagnetic energy in the cavity and/or in the object placed in the cavity may be different for different frequencies. Some frequencies may be associated with a higher energy absorption than other frequencies. Applying electromagnetic energy at all frequencies may result in higher energy absorption in certain locations in the object that are associated with higher energy absorption and thus may result in undesired local rises in temperature. In some embodiments, a choice may be made not to apply electromagnetic energy to frequencies associated with high absorbable energy (e.g., frequencies with a high dissipation ratio). A threshold value of absorbable energy may be determined, such that energy is not applied to the cavity at frequencies associate with energy absorbable value above the threshold value. The threshold value may be predetermined prior to the energy application, either as a fixed value or a value that changes, for example, during the electromagnetic energy application. Additionally or alternatively, the threshold value may be determined during the electromagnetic application. In some embodiments, the threshold may be determined based on a feedback received from the cavity. For example, the threshold may be determined such that no energy is applied to the energy application zone at frequencies associated with a dissipation ratio above 0.7, 0.75, 0.8, 0.85 or 0.9.

In the presently disclosed embodiments, a dissipation ratio may be calculated using formula (1):

$$DR=(P_{in}-P_{rf}-P_{cp})/P_{in} \quad (1)$$

where $P_{in}$ represents the electromagnetic energy applied into zone 9 by antennas 102, $P_{rf}$ represents the electromagnetic energy reflected/returned at those antennas that function as transmitters, and $P_{cp}$ represents the electromagnetic energy coupled at those antennas that function as receivers. DR may be a value between 0 and 1, and, in the presently disclosed embodiments, may be represented by a percentage number.

Figure 5B:
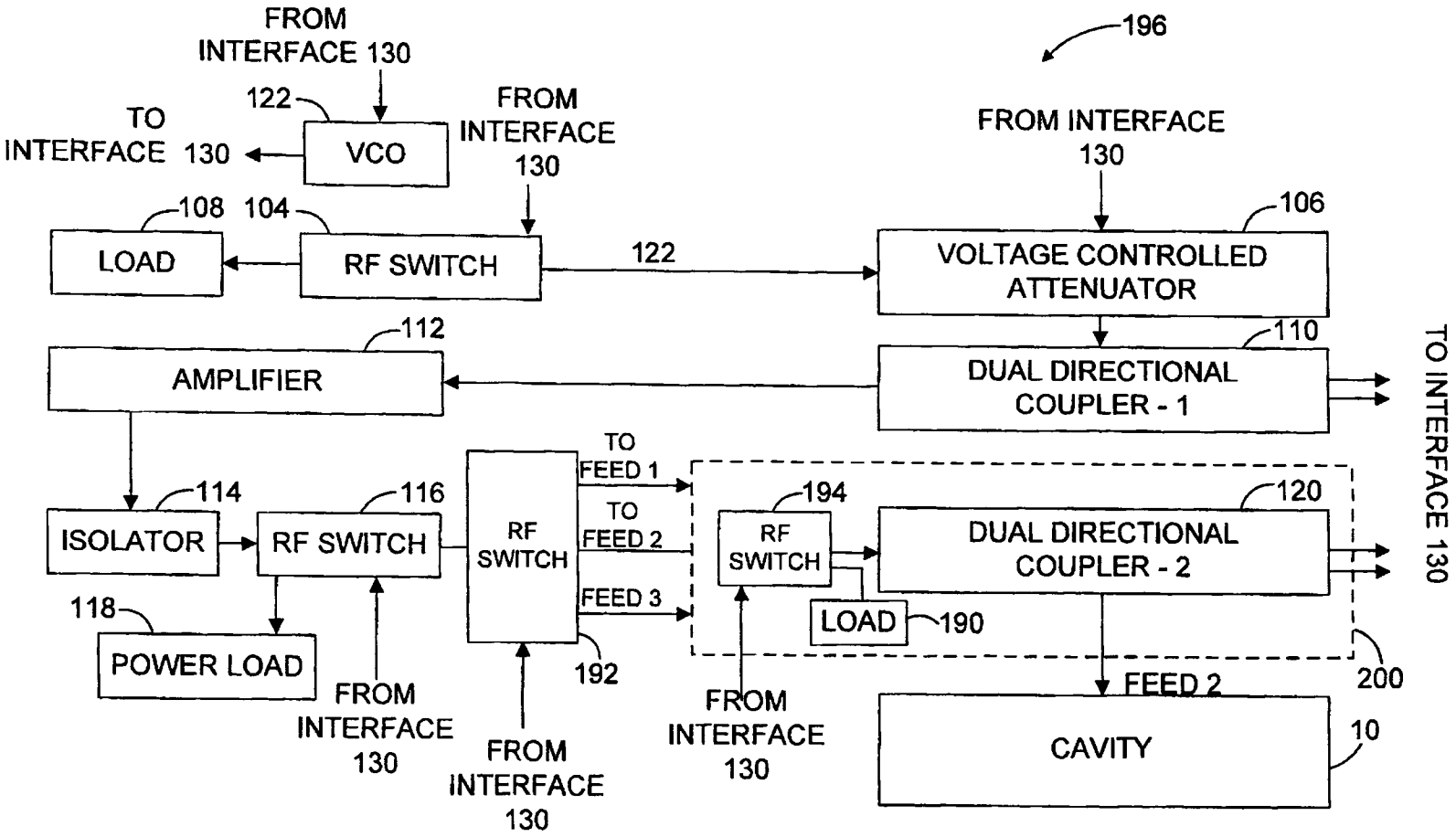
FIG. 5B is a schematic block diagrams of another exemplary electromagnetic energy application subsystem, in accordance with some embodiments of the present invention.

For example, consistent with the embodiment of FIG. 5B which is designed for three antennas 1, 2, and 3, computing subsystem 92 in controller 101 (e.g., as illustrated in FIG. 1) may be configured to determine input reflection coefficients $S_{11}$, $S_{22}$, and $S_{33}$ and the transfer coefficients $S_{12}=S_{21}$, $S_{13}=S_{31}$, $S_{23}=S_{32}$ based on the measured power information during the sweep. Accordingly, the dissipation ratio DR corresponding to antenna 1 may be determined based on these coefficients, according to formula (2):

$$DR=1-(|S_{11}|^2+|S_{12}|^2+|S_{13}|^2). \quad (2)$$

Figure 11:
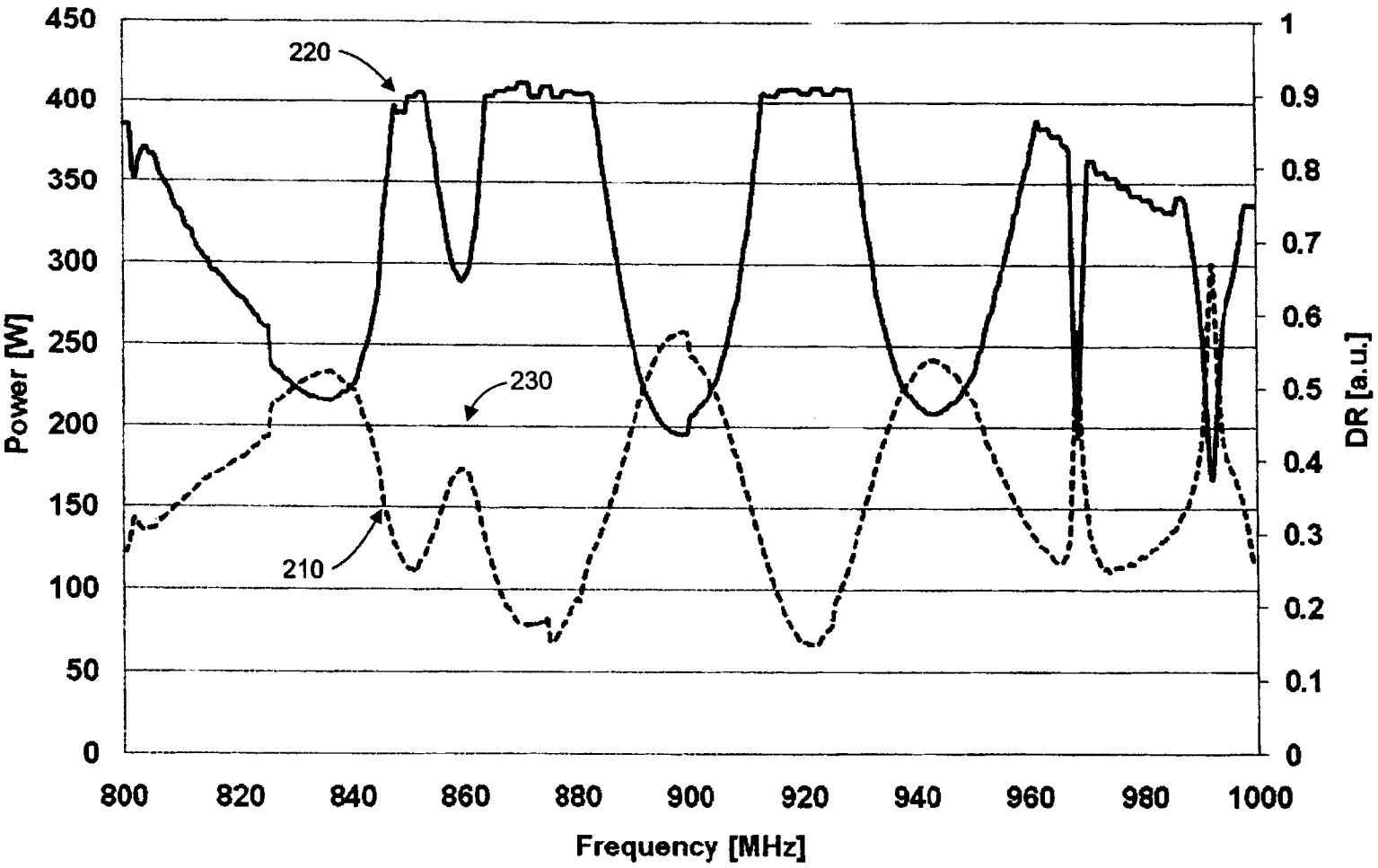
FIG. 11 illustrates a dissipation ratio spectrum (dashed line) and an input energy spectrum (solid line), in accordance with some embodiments of the invention.
Figure 12:
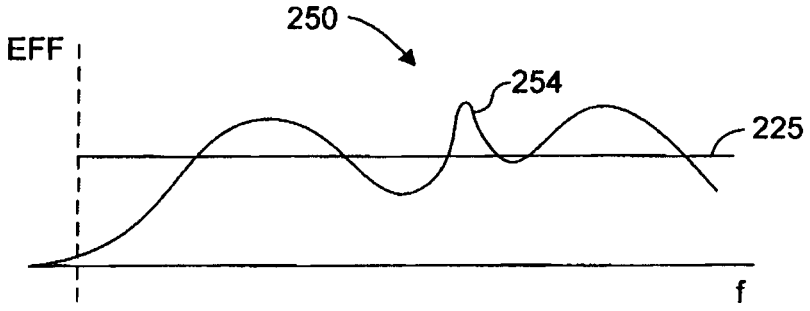
FIG. 12 illustrate a dissipation ratio spectrum, in accordance with some embodiments of the invention.

For a given object 11, the dissipation ratio may change as a function of the frequency of the applied electromagnetic energy. Accordingly, a dissipation ratio spectrum may be generated by plotting the dissipation ratio associated with each frequency against the respective frequencies. Exemplary dissipation ratio (efficiency) spectrums 210 and 250 are illustrated in FIG. 11 and FIG. 12, respectively. FIG. 11 and FIG. 12 depict frequencies corresponding to both high and low dissipation ratios, and illustrate dissipation ratio peaks that are broader than others.

According to some exemplary embodiments, the at least one processor may be configured to regulate subsystem 96 for measuring a first amount of incident energy at a transmitting antenna at a first frequency; measure a second amount of energy reflected at the transmitting antenna as a result of the first amount of incident energy; measure a third amount of energy transmitted to a receiving antenna as a result of the first amount of incident energy; and determine the dissipation ratio based on the first amount, the second amount, and the third amount. By way of example, controller 101 may be configured to measure a first amount of incident energy at a first antenna 102 which performs as a transmitter at a first frequency, measure a second amount of energy reflected at first antenna 102 as a result of the first amount of incident energy, measure a third amount of energy transmitted to at least one second antenna 102 which performs as a receiver as a result of the first amount of incident energy, and determine the dissipation ratio based on the first amount, the second amount, and the third amount.

The value indicative of the absorbable energy may further involve the maximum incident energy associated with power amplifier 112, illustrated, for example, in FIGS. 5A and 5B, of subsystem 96 at the given frequency. As referred herein, a "maximum incident energy" may be defined as the maximal power that may be provided to the antenna at a given frequency throughout a given period of time. Thus, one alternative value indicative of absorbable energy may be the product of the maximum incident energy and the dissipation ratio. These are just two examples of values that may be indicative of absorbable energy which could be used alone or together as part of control schemes implemented in controller 101. Alternative indicia of absorbable energy may be used, depending on the structure employed and the application.

In certain embodiments, the at least one processor may also be configured to cause energy to be supplied to the at least one radiating element in at least a subset of the plurality of frequencies, wherein energy applied to the zone at each of the subset of frequencies may be a function of the absorbable energy value at each frequency. In some embodiments, energy applied to the zone at each of the frequencies (e.g., at each of the frequencies for which a DR was calculated) may be a function of the absorbable energy value at the applied frequency. For example, the energy applied to the at least one antenna 102 at each of the subset of frequencies may be determined as a function of the absorbable energy value at each frequency (e.g., as a function of a dissipation ratio, maximum incident energy, a combination of the dissipation ratio and the maximum incident energy, or some other indicator). In the presently disclosed embodiments, this may occur as the result of absorbable energy feedback obtained during a frequency sweep. That is, using this absorbable energy information, the at least one processor may adjust energy applied at each frequency such that the energy at a particular frequency may in some way be a function of an indicator of absorbable energy at that frequency. The functional correlation may vary depending upon application. For some applications where absorbable energy is relatively high, there may be a desire to have the at least one processor implement a function that causes a relatively low application of energy at each of the emitted frequencies. In some embodiments, for example, a processor may restrict application of energy at frequencies where absorbable energy is relatively high (e.g., having a DR above 70%, 75%, 80% or 90%). This may be desirable, for example when a more uniform energy distribution profile is desired across object 11, as will be discussed later in greater detail.

For other applications, there may be a desire to have the at least one processor implement a function that causes a relatively high energy application. This may be desirable to target specific areas of an object with higher absorbable energy profiles. For yet other applications, it may be desirable to customize the amount of energy supplied to a known or suspected energy absorption profile of the object 11. In still other applications, a dynamic algorithm or a look up table can be applied to vary the energy applied as a function of at least the absorbable energy and perhaps one or more other variables or characteristics. These are a few examples of how energy applied into the zone at each of the subset of frequencies may be a function of the absorbable energy value at each frequency. The invention is not limited to any particular scheme, but rather may encompass any technique for controlling the energy supplied by taking into account an indicator of absorbable energy.

In certain embodiments, the energy applied to the at least one radiating element at each of the subset of frequencies may be a function of the absorbable energy values at the plurality of frequencies other than the frequency at which energy is supplied. For example, in the presently disclosed embodiments, the dissipation ratios at a range of "neighborhood" frequencies around the frequency at issue may be used for determining the amount of energy to be applied. In the presently disclosed embodiments, the entire working band excluding certain frequencies that are associated with extremely low dissipation ratios (which may be associated with metallic materials, for example) may be used for the determination.

In certain embodiments, the at least one processor may be configured to cause energy to be supplied to the at least one radiating element in the plurality of frequencies, wherein energy applied to the zone at each of the plurality of frequencies may be inversely related to the absorbable energy value at each frequency. In certain embodiments, the at least one processor may be configured to cause energy to be supplied to the at least one radiating element in at least a subset of the plurality of frequencies, wherein energy applied to the zone at each of the subset of frequencies may be inversely related to the absorbable energy value at each frequency. Such an inverse relationship may involve a general trend—when an indicator of absorbable energy in a particular frequency subset (i.e., one or more frequencies) tends to be relatively high, the actual incident energy at that frequency subset may be relatively low. And when an indicator of absorbable energy in a particular frequency subset tends to be relatively low, the incident energy may be relatively high. The inverse relationship may be even more closely correlated. For example, in the presently disclosed embodiments, the applied energy may be set such that its product with the absorbable energy value (i.e., the absorbable energy by object 11) is substantially constant across the frequencies applied. In either case, a plot of applied energy may generally appear as a reverse image of a value indicative of absorption (e.g., dissipation ratio or a product of the dissipation ratio and the maximal incident power available at each transmitted frequency). For example, FIG. 11 provides a plotted example of a dissipation ratio spectrum 210 (dashed line) and a corresponding incident power spectrum 220 (solid line) taken during operation of a device constructed and operated in accordance with the presently disclosed embodiments. The plots shown in FIG. 11 were taken with an oven having a maximum incident power of about 400 Watts, wherein a 100 gr chunk of minced beef was placed. A range of frequencies between 800 MHz and 1 GHz was swept, and energy was supplied based on the sweep, such that essentially uniform dissipation of energy will be affected in the chunk of beef.

In some embodiments the processor may be configured to determine a threshold value for the value indicative of energy absorbable in the object as a function of the frequencies. The processor may further be configured to decrease or prevent energy applied at frequencies having value indicative of energy absorbable above the threshold value. For example, threshold 230 in FIG. 11 may be determined such that little or no energy is applied to energy application zone 9 at frequencies associated with dissipation ratio above 0.48. In other embodiments, a threshold may be determined such that application of energy to energy application zone 9 is decreased or prevented at frequencies associated with dissipation ratio above 0.7, 0.75, 0.8, 0.85 or 0.9.

In certain embodiments, the at least one processor may be configured to adjust energy applied such that when the energy applied is plotted against an absorbable energy value over a range of frequencies, the two plots tend to mirror each other. In some embodiments, the two plots may tend to mirror each other at at least one subset of the range of frequencies. In the presently disclosed embodiments, the two plots may be mirror images of each other. In the presently disclosed embodiments, the plots may not exactly mirror each other, but rather, have generally opposite slope directions, i.e., when the value corresponding to a particular frequency in one plot is relatively high, the value corresponding to the particular frequency in the other plot may be relatively low. For example, as shown in FIG. 11, the relationship between the plot of applied energy (e.g., incident power spectrum 220) and the plot of the absorbable energy values (e.g., dissipation ratio spectrum 210) may be compared such that when the applied energy curve is increasing, over at least a section of the curve, the absorbable energy curve will be decreasing over the same section. Additionally, when the absorbable energy curve is increasing, over at least a section of the curve, the applied energy curve will be decreasing over the same section. For example, in FIG. 11, incident power spectrum 220 increases over the frequency range of 900 Hz-920 Hz, while dissipation ratio spectrum 210 decreases over that frequency range. At times, the curve of applied energy might reach a maximum value, above which it may not be increased, in which case a plateau (or almost plateau) may be observed in the transmission curve, irrespective of the absorbable energy curve in that section. For example, in FIG. 11, when the incident power reaches the maximum value of 400 W, the incident power stays substantially constant regardless of the variations in the dissipation ratio.

Some exemplary schemes can lead to more spatially uniform energy absorption in the object 11. As used herein, "spatial uniformity" refers to a condition where the energy absorption (i.e., dissipated energy) across the object or a portion (e.g., a selected portion) of the object that is targeted for energy application is substantially constant. The energy absorption is considered "substantially constant" if the variation of the dissipated energy at different locations of the object is lower than a threshold value. For instance, a deviation may be calculated based on the distribution of the dissipated energy, and the absorbable energy is considered "substantially constant" if the deviation is less than 50%. Because in many cases spatially uniform energy absorption may result in spatially uniform temperature increase, consistent with the presently disclosed embodiments, "spatial uniformity" may also refer to a condition where the temperature increase across the object or a portion of the object that is targeted for energy application is substantially constant. The temperature increase may be measured by a sensing device, for example, a temperature sensor in zone 9.

In order to achieve approximate substantially constant energy absorption in an object or a portion of an object, controller 101 may be configured to hold substantially constant the amount of time at which energy is supplied to antennas 102 at each frequency, while varying the amount of power supplied at each frequency as a function of the absorbable energy value.

In certain situations, when the absorbable energy value is below a predetermined threshold for a particular frequency or frequencies, it may not be possible to achieve uniformity of absorption at each frequency. In such instances, consistent with the presently disclosed embodiments, controller 101 may be configured to cause the energy to be supplied to the antenna for that particular frequency or frequencies a power level substantially equal to a maximum power level of the device. Alternatively, consistent with some other embodiments, controller 101 may be configured to cause the amplifier (e.g. amplifier 112) to apply no energy at all at these particular frequency or frequencies. At times, a decision may be made to apply energy at a power level substantially equal to a maximum power level of the amplifier only if the amplifier may apply to the object at least a threshold percentage of energy as compared with the uniform applied energy level (e.g. 50% or more or even 80% or more). At times, a decision may be made to apply energy at a power level substantially equal to a maximum power level of the amplifier only if the reflected energy is below a predetermined threshold, in order, for example, to protect the apparatus from absorbing excessive power. For example, the decision may be made based on the temperature of a dummy load into which reflected energy is introduced, or a temperature difference between the dummy load and the environment. The at least one processor may accordingly be configured to control the reflected energy or the absorbed energy by a dummy load. Similarly, if the absorbable energy value exceeds a predetermined threshold, the controller 101 may be configured to cause the antenna to apply energy at a power level less than a maximum power level of the antenna. In some embodiments, if the absorbable energy value exceeds a predetermined threshold, the controller 101 may be configured to cause the antenna to apply little or no energy (low or zero power level).

In an alternative scheme, uniform absorption may be achieved by varying the duration of energy application while maintaining the power applied at a substantially constant level. In other words, for frequencies exhibiting lower absorbable energy values, the duration of energy application may be longer than for frequencies exhibiting higher absorption values. In this manner, an amount of power supplied at multiple frequencies may be substantially constant, while an amount of time at which energy is supplied varies, depending on an absorbable energy value at the particular frequency.

In certain embodiments, the at least one antenna may include a plurality of antennas, and the at least one processor may be configured to cause energy to be supplied to the plurality of antennas using waves having distinct phases. For example, antenna 102 may be a phased array antenna including a plurality of antennas forming an array. Energy may be supplied to each antenna with electromagnetic waves at a different phase. The phases may be regulated to match the geometric structure of the phased array. In the presently disclosed embodiments, the at least one processor may be configured to control the phase of each antenna dynamically and independently. When a phased array antenna is used, the energy supplied to the antenna may be a sum of the energy supplied to each of the antennas in the array.

Because absorbable energy can change based on a host of factors including object temperature, depending on application, it may be beneficial to regularly update absorbable energy values and thereafter adjust energy application based on the updated absorbable values. These updates can occur multiple times a second, or can occur every few seconds or longer, depending on application. As a general principle, more frequent updates may increase the uniformity of energy absorption.

In accordance with the presently disclosed embodiments, a controller may be configured to adjust energy applied from the antenna as a function of the frequency at which the energy is applied. For example, regardless of whether a sweep or some other active indicator of energy absorption is employed, certain frequencies may be targeted or avoided for energy application. That is, there may be frequencies that the controller 101 avoids altogether, such as where the absorption level falls below a predetermined threshold. For example, metals tend to be poor absorbers of electromagnetic energy, and therefore certain frequencies associated with metals will exhibit low absorption indicator values. In such instances the metals may fit a known profile, and associated frequencies may be avoided. Or, an absorption indicator value may be dynamically determined, and when it is below a predetermined threshold, controller 101 may prevent an antenna 102 from thereafter applying electromagnetic energy at such frequencies. Alternatively, if it is desirable to apply energy to only portions of an object, energy can be targeted to those portions if associated frequency thresholds are either known or dynamically determined.

In accordance with another aspect of the invention, the at least one processor may be configured to determine a desired energy absorption amount and adjust energy supplied from the antenna at each frequency in order to target or achieve the desired energy absorption amount. In accordance with another aspect of the invention, the at least one processor may be configured to determine a desired energy absorption amount at each of a plurality of frequencies and adjust energy supplied from the antenna at each frequency in order to target the desired energy absorption amount at each frequency. For example as discussed earlier, controller 101 may be configured to target a desired energy absorption amount at each frequency in attempt to achieve or approximate substantially uniform energy absorption across a range of frequencies. Alternatively, controller 101 may be configured to target an energy absorption profile across object 11, which is calculated to avoid uniform energy absorption, or to achieve substantially uniform absorption in only a portion of object 11.

Some or all of the forgoing functions and control schemes, as well as additional functions and control schemes, may be carried out, by way of example, using structures such as the electromagnetic energy application subsystems schematically depicted in FIGS. 5A and 5B.

Within the scope of the invention, alternative structures might be used for accomplishing the functions described herein, as would be understood by a person of ordinary skill in the art, reading this disclosure.

Embodiments of the invention may include a source of electromagnetic energy. A "source" may include any components that are suitable for generating electromagnetic energy. Consistent with the invention, the source may be configured to apply electromagnetic energy to the energy application zone in the form of propagating electromagnetic waves at predetermined wavelengths or frequencies (also known as electromagnetic radiation). As used herein, "propagating electromagnetic waves" may include resonating waves, evanescent waves, and waves that travel through a medium in any other manner. Electromagnetic radiation carries energy that may be imparted to (or dissipated into) matter with which it interacts.

Such a source may include, for example, electromagnetic energy application subsystem 96, as depicted in the schematic of FIG. 5A. Subsystem 96 may be a source of electromagnetic energy such as an RF feed system. and may include, among other things, a voltage control oscillator (VCO) 122, an RF switch 104, a voltage controlled attenuator (VCA) 106, a load 108, a dual directional coupler 110, an amplifier 112, an isolator 114, an RF switch 116, a power load 118, and a dual directional coupler 120, interconnected as illustrated in FIG. 5A. It is contemplated that subsystem 96 may include fewer or additional components.

VCO 122 may be configured to receive a signal from interface 130 (described in greater details in connection with FIG. 7), which may set the frequency of the electromagnetic energy into the port. This energy may be passed through RF switch 104 and VCA 106, both of which may be controlled by signals from interface 130. After passing through VCA 106, the magnitude and frequency of the signal may be set. Consistent with the presently disclosed embodiments, load 108 may be included in subsystem 96 for dumping a signal generated by VCO 122 when the signal from VCO 122 is not switched to VCA 106.

The signal may then be sent through a main line of dual directional coupler 110. The output of coupler 110 may be amplified by power amplifier 112 and then passed through isolator 114. Consistent with the presently disclosed embodiments, a signal proportional to the energy reflected from amplifier 112 may also be fed to interface 130. Coupler 110 may feedback a portion of the signal entering it to interface 130. These signals may enable supervision of VCO 122/VCA 106 and amplifier 112. In the presently disclosed embodiments such as a production system, dual directional coupler 110 may be omitted.

RF switch 116 may be configured to switch power either to power load 118 or to antennas 102, via dual directional coupler 120. Dual directional coupler 120 may be configured to sample the electromagnetic energy transmitted into and received from cavity 10 and send the energy measurement signals to interface 130.

Consistent with the presently disclosed embodiments, RF amplifier 112 may be a solid state amplifier based on the LDMOS technology with a Psat=300 W, an efficiency=about 22%, and an effective band of 800-1000 MHz. Such amplifiers may either have a relatively narrow bandwidth or a low efficiency (<25%) or both.

Consistent with some embodiments, amplifier 112 (e.g., RF amplifier) may be based on SiC (silicon carbide) or GaN (gallium nitride) semiconductor technology, with a potential efficiency for example of 70%. Transistors utilizing such technologies are commercially available from companies, such as Eudyna, Nitronex and others. Amplifiers having a maximum power output of 300-600 W (can be built from low power (50-100 Watt) modules) and a bandwidth of 600 MHz (at 700 MHz center frequency) or a bandwidth of 400 MHz (at 2.5 GHz center frequency) may be used as RF amplifier 112. Such amplifiers may have a much higher efficiency (e.g., an efficiency of 60% consistent with the presently disclosed embodiments) than prior art amplifiers and much higher tolerance to reflected signals. Due to the high efficiency of RF amplifier 112, isolator 114 may be omitted consistent with the presently disclosed embodiments.

While a few amplifier examples are described above, it should be understood that the invention is not limited to a particular structure. To the extent that an amplification function is employed in alternative embodiments, within the scope and spirit of the invention, an amplification function can be accomplished with alternative structures, as would be understood by persons of ordinary skill in the art, reading this disclosure.

The schematic of FIG. 5B illustrates an alternative exemplary electromagnetic energy application subsystem 196, consistent with exemplary embodiments of the invention. As illustrated, subsystem 196 may include components similar to those discussed in connection with FIG. 5A, such as RF switch 192 configured to switch the output of RF switch 116 to one antenna among a plurality of antennas associated with cavity 10, and circuitry 200 coupled to the selected antenna. Although FIG. 5B only shows circuitry 200 corresponding to antenna 2 (i.e., via feed 2), it is contemplated that subsystem 196 may include additional circuitries corresponding to additional antennas, such as antennas 1 and 3. Furthermore, although the embodiment of FIG. 5B illustrates RF switch 192 for switching signals among three antennas (i.e., via three feeds), it is contemplated that RF switch 192 may be configured to switch signals among more or fewer antennas.

Circuitry 200 may also include, among other things, an RF switch 194, a load 190 and dual directional coupler 120, interconnected, for example, as illustrated in FIG. 5B. Circuitry 200 may operate in one of two modes. Consistent with the presently disclosed embodiments, circuitry 200 may operate in a power transfer mode. For example, a signal from interface 130 may switch power from RF switch 192 to dual directional coupler 120, via RF switch 194. The rest of the operation may be similar to those as described above in connection with FIG. 5A. Consistent with some embodiments, circuitry 200 may operate in a passive mode. For example, RF switch 194 may not receive power from power amplifier 112 (referred to interchangeably as "power amplifier 112" and "amplifier 112"). Rather, RF switch 194 may connect load 190 to the input of dual directional coupler 120. In the passive mode, load 190 may be configured to absorb power that is received from cavity 10.

In the presently disclosed embodiments, dual directional coupler 120 may be excluded. Alternatively or additionally, RF switch 194 may be replaced by a circulator such that power returned from antenna 2 may be always dumped at load 190. Furthermore, although FIG. 5B shows RF switches 104, 116, 192, and 194 as separate switches, it is contemplated that any two or more of these switches may be combined into a more complex switch network.

Figure 6:
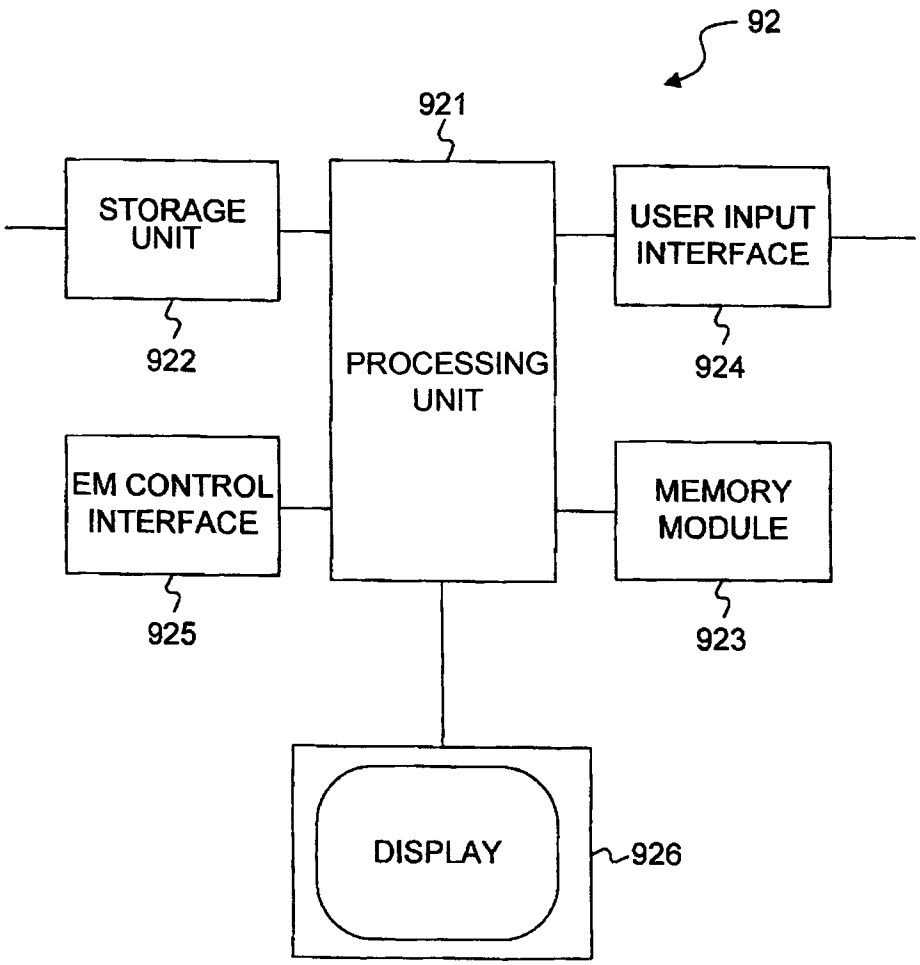
FIG. 6 is a schematic block diagram of a calculation subsystem, in accordance with some embodiments of the present invention.

FIG. 6 is a schematic block diagram of an exemplary computing subsystem 92, in accordance with the presently disclosed embodiments. As illustrated, computing subsystem 92 may include, among other things, a processing unit 921, a storage unit 922, a memory module 923, a user input interface 924, an electromagnetic control interface 925, and a display device 926. These units may be configured to transfer data and send or receive instructions between or among each other. Each unit of subsystem 92 is described below. Depending on design parameters and intended use, certain embodiments may include more or fewer than all of the components described.

Processing unit 921 may include any suitable microprocessor, digital signal processor, or microcontroller. In the presently disclosed embodiments, processing unit 921 may be part of the at least one processor in controller 101. Processing unit 921 may be configured to communicate with electromagnetic control interface 925 to provide control instructions to electromagnetic energy application subsystem 96 or 196 and/or obtain measured energy information received from subsystem 96. Consistent with the presently disclosed embodiments, processor 921 may be configured to execute a frequency sweeping process during which electromagnetic energy at a plurality of frequencies is applied (e.g., sequentially) to zone 9. Processing unit 921 may be further configured to determine a value indicative of energy absorbable by object 11 at each of the plurality of frequencies based on the received information during the frequency sweep process. Processing unit 921 may also be configured to select one or more frequencies, among the plurality of frequencies swept, and determine the magnitude of electromagnetic energy for subsequent application at each selected frequency, as described earlier.

Storage unit 922 may include any appropriate type of mass storage provided to store any type of information that processing unit 921 may need to operate. For example, storage unit 922 may include one or more of a RAM, ROM, cache memory, dynamic RAM, static RAM, flash memory, a magnetic disk, an optical disk, or any other structure for storing information. Similarly, memory module 923 may include one or more memory devices identified in the list above. The computer program instructions may be accessed and read from the ROM, or any other suitable memory location, and loaded into the RAM for execution by processor 921.

In the presently disclosed embodiments, both storage unit 922 and memory module 923 may be configured to store information used by processing unit 921, and the functions of both may be combined in a single structure or multiple structures. For example, storage unit 922 and/or memory module 923 may be configured to store one or more parameters of electromagnetic energy determined by processing unit 921. Consistent with the presently disclosed embodiments, these parameters may include frequencies of the applied electromagnetic energy, and magnitudes of the energy at these corresponding frequencies. Storage unit 922 and/or memory module 923 may also be configured to store other intermediate parameters determined by processing unit 921.

User input interface 924 may be any device accessible by the operator of apparatus 100 to input a control signal. For example, user input interface 924 may include one or more of a graphic interface (e.g., Graphical User Interface), one or more hard or soft buttons, a keyboard, a switch, a mouse, or a touch screen.

Electromagnetic control interface 925 may be configured to obtain data from subsystem 96 or 196 via interface 130 and/or to transmit data to these components. For example, electromagnetic control interface 925 may be coupled with interface 130 and be configured for two way communication between subsystem 92 and subsystem 96 or 196. Consistent with the presently disclosed embodiments, electromagnetic control interface 925 may be configured to provide the plurality of sweeping frequencies to subsystem 96 during the frequency sweeping process and receive from subsystem 96 reflected and/or coupled electromagnetic energy measurements.

Computing subsystem 92 may also provide visualized information to the user via display device 926. For example, display device 926 may include a computer screen and provide a graphical user interface ("GUI") to the user. In some embodiments, when user input interface 924 is a touch screen, user input interface 924 and display device 926 may be incorporated in a single device. Consistent with the presently disclosed embodiments, display device 926 may display a chart illustrating the absorbable energy value plotted against the swept frequencies. Display device 926 may also display a chart illustrating the magnitude of applied electromagnetic energy plotted against the selected frequencies.

Figure 7:
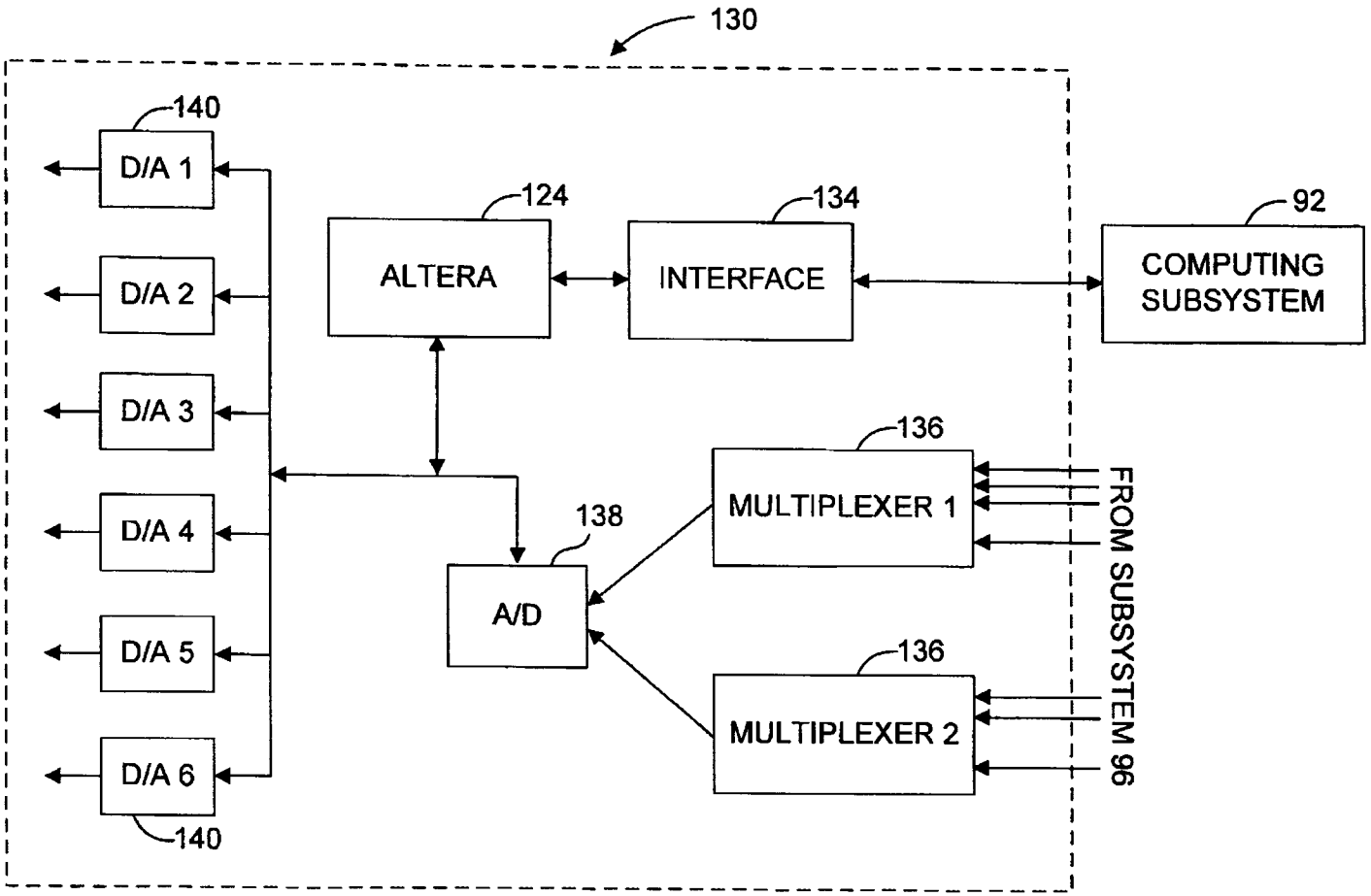
FIG. 7 is a schematic block diagram of an exemplary interface 130, in accordance with some embodiments of the present invention.

FIG. 7 is a schematic block diagram of an exemplary interface 130, in accordance with the presently disclosed embodiments. Interface 130 may be coupled to computing subsystem 92 through an interface 134. Interface 134 may be configured to communicate with, for example, an ALTERA FPGA 124. ALTERA FPGA 124 may be coupled to the various elements of subsystem 96 or 196 and may be configured to provide control signals to one or more of these elements. Additionally, ALTERA FPGA 124 may be configured to receive inputs via one or more multiplexers 136 and an A/D converter 138.

During a frequency sweeping process such as described in connection with FIG. 6, ALTERA FPGA 124 may be configured to set the frequency and magnitude of the applied electromagnetic energy, determined by computing subsystem 92, via D/A converters 140. In the presently disclosed embodiments, ALTERA FPGA 124 may be further configured to set positions of field adjusting elements 22 and 24. When used, for example, in connection with a production system, subsystem 92 may not be included and ALTERA FPGA 124 or a similar controller may be configured for executing the frequency sweeping process.

Figure 8:
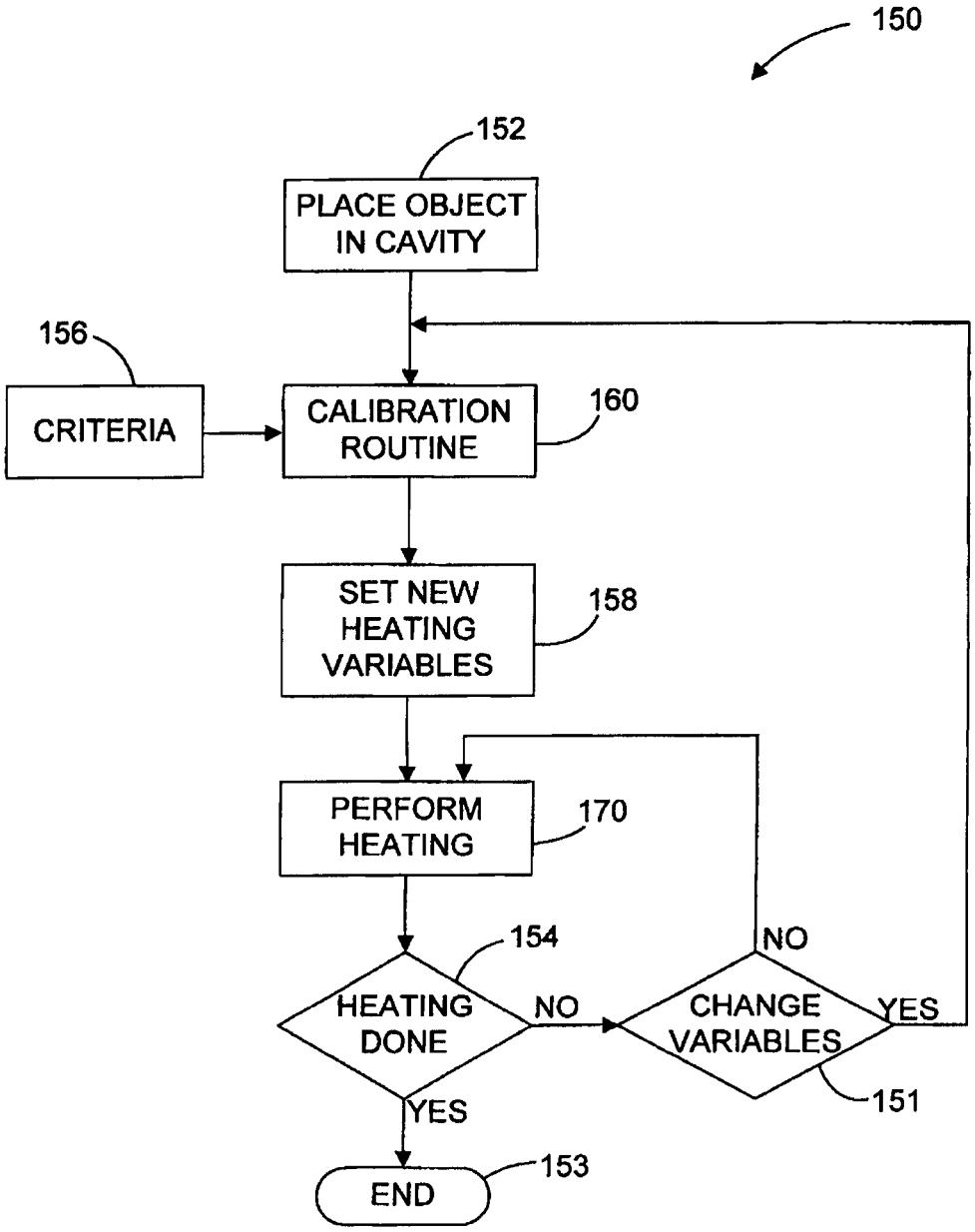
FIG. 8 is a flow chart of an exemplary operation process in accordance with some embodiments of the invention.

FIG. 8 is a flow chart of an exemplary operation process 150 of apparatus 100, in accordance with the presently disclosed embodiments. With little or minor changes, operation process 150 may be used for apparatuses with smaller or greater numbers of antennas and/or a smaller or greater number of field adjusting elements. Although operation process 150 is describe in connection with a heating application, it is contemplated that with minor changes, operation process 150 may be used for applications other than heating.

In step 152, object 11, for example, a frozen organ, frozen or a non-frozen food object, or any other type of object as previously defined, may be placed in cavity 10. In step 160, a calibration or adjustment routine may then be performed to set operating variables associated with various components of apparatus 100. Depending on the particular application, these variables may include power output (e.g., by amplifier 112 to cavity 10) at each antenna 102 at each frequency; a subset of frequencies of each VCO 122; a selected method of providing electromagnetic energy at the subset of frequencies (for example sequentially applying energy at the subset of frequencies or simultaneously applying energy having the desired frequency and power characteristics as a pulsed signal); positions of the field adjusting elements 22 and 24, position of object 11, and any other adjustable variables associated with the electromagnetic energy application process.

A calibration routine may be performed to ensure the uniformity of electromagnetic energy applied to different portions of object 11. Consistent with the presently disclosed embodiments, step 160 may include a frequency sweeping process for determining operating variables for apparatus 100 such that the absorbable energy is substantially uniform throughout object 11. Calibration routine may be executed by processing unit 921 in subsystem 92. Criteria 156 may be provided to the calibration routine. In the presently disclosed embodiments, criteria 156 may be stored in storage device 922 and/or memory module 923 in subsystem 92. An exemplary calibration process and exemplary criteria are described in greater details in connection with FIG. 9.

In step 158, after the variables are determined, these variables are set in the various components of apparatus 100 through subsystem 96 and heating may commence in step 170. During the heating process, electromagnetic energy may be applied to cavity 10 via antennas 102, for example, antennas 16, 18, and/or 20. Consistent with either the embodiment of FIG. 5A or the embodiment of FIG. 5B, the frequency of the electromagnetic energy supplied to the antennas may be supplied at the center frequency of the resonance mode that couples the highest net power, i.e., the maximum percentage of energy absorbable by object 11.

Alternatively, frequencies may be swept sequentially across a range of the cavity 10 resonance frequencies or, more preferably along a portion of the range. Consistent with the presently disclosed embodiments, the magnitude of the supplied power may be adjusted during this sweep so that the absorbable energy at each frequency remains constant or substantially constant during the sweep. For example, amplification ratio of power amplifier 112 may be changed inversely with the energy absorption characteristic of object 11, as were described earlier in connection with FIG. 11.

In the presently disclosed embodiments, power may be applied over a predetermined time at each frequency to obtain a certain amount of electromagnetic energy. For example, 1 J energy may be applied at 300 MHz in 1 millisecond and 2 J may be applied at 310 MHz in another 1 millisecond. Alternatively or additionally, an amount of electromagnetic energy may be applied during a variable amount of time at each frequency. In particular, the amount of time may be determined for each frequency, such that the applied power at each frequency is substantially the same. For example, 1 J energy may be applied at 300 MHz in 1 milliseconds and 2 J may be applied at 310 MHz in 2 milliseconds, so that the supplied power at each of the two frequencies is 1000 W.

Energy application may be interrupted periodically (e.g., several times a second) for a short time (e.g., only a few milliseconds or tens of milliseconds). Once energy application (e.g., for heating as disclosed in connection with FIG. 8) is interrupted, in step 154, it may be determined if the heating should be terminated. The criteria for termination may vary depending on application. It may be based on time, temperature, total energy absorbed (e.g., total energy absorbed by the object), or any other indicator that the process at issue is compete. In connection with the heating embodiment of FIG. 8, for example, heating may be terminated when the temperature of object 11 rises to a predetermined temperature threshold. If in step 154, it is determined that heating should be terminated (step 154: yes), heating may end in step 153.

If the criterion or criteria for terminating heating is not met (step 154: no), it may be determined if the variables should be re-determined and reset in step 151. If not (step 151: no), process may return to step 170 and continue to provide heating. Otherwise (step 151: yes), process may return to calibration routine 160 and determine new variables for apparatus 100. Consistent with the presently disclosed embodiments, less frequencies may be swept in a calibration process performed during the heating phase than those swept in a calibration process performed before the heating phase, such that the heating process is interrupted for a minimum amount of time.

By way of example only, calibration routine 160 may be performed 120 times in a minute during the heating phase. Higher (e.g. 200/min, 300/min) or lower (e.g., 100/min, 20/min, 2/min, 10/heating time, 3/heating time) calibration rates are also non-limiting examples of performance rates that might be used, depending on the details of a desired application. Thus, while in some applications calibrations may be performed once every 0.5 seconds or once every 5 seconds, a nearly infinite range of possibilities exist. Moreover, non-uniform calibration rates may be used. For example, the first interruption may occur after 0.5 second, while the second interruption may occur after another 0.8 second.

According to other embodiments, the calibration rate may be dynamically determined based on the amount of energy applied into cavity 10 and/or the amount of energy dissipated into object 11. For example, in step 151, it may be determined that new variables are needed, only if a given amount of energy (e.g., 10 kJ or less or 1 kJ or less or several hundreds of joules or even 100 J or less) has been applied or dissipated into object 11 or into a given portion of object 11 (e.g., by weight such as 100 g or by percentage, such as 50% of object 11). Consistent with other embodiments, the determination in step 151 may be made based on information provided by other means, for example an RF/bar-code readable tag (e.g., containing previously determined energy application information or an amount of energy to be dissipated in the object) or temperature sensors that measure the temperature of object 11.

In some embodiments, heating may be terminated once one or more sensor(s) indicate that certain criteria are met. Such criteria may indicate, for example: once sufficient amount of energy is absorbed in the object, once one or more portions of the object are at a predetermined temperature, once time derivatives of absorbed power changes. Such automatic processing adjustment may be useful, for instance, in vending machines where food products are heated or cooked when purchased. Purchase may start the heating and specific heating conditions (for example, energy supplied at each frequency) may be determined in accordance with feedback from the heated product, for example. Additionally or alternatively, heating may be stopped once the sensors sense conditions that are defined to the controller as stopping criteria. Additionally or alternatively, cooking or processing instructions may be provided on a machine readable element (e.g., barcode or a tag, associated with the processed object). The processed object may be, for example, heated food product purchased in the vending machine.

In yet other embodiments, the determination in step 151 may be made based on the rate of change in spectral information between interruptions. For example, a threshold of change in dissipation and/or frequencies (e.g., a 10% change in sum integral) may be provided, and once the threshold is exceeded, a calibration may be performed. As another example, different change rates may be provided corresponding to different calibration rates, for example in a form of look-up table. In an alternative scheme, the rate of change may be determined as the average changes between every two calibrations. Such changes may be used to adjust the period between two calibrations once or more than once during a heating session. Additionally or alternatively, the rate of calibration may also be affected by changes in apparatus 100 (e.g., if used in an oven, movement of a plate on which the object is located). Optionally, major changes may increase the rate and minor or no changes may decrease it.

Figure 9:
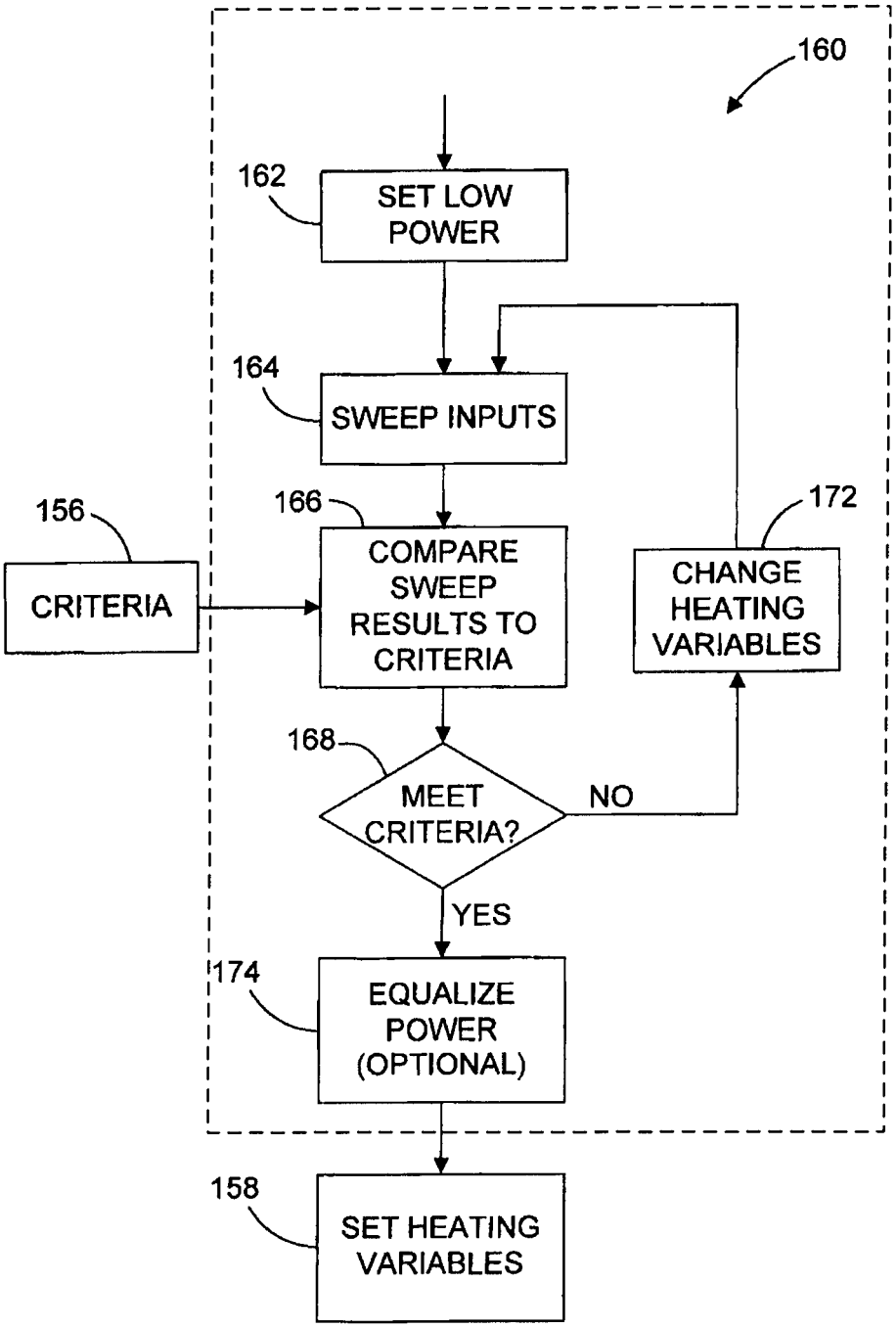
FIG. 9 is a flow chart of an exemplary process for the calibration routine of FIG. 8, in accordance with some embodiments of the invention.

FIG. 9 is a flow chart of an exemplary process for the calibration routine 160 of FIG. 8, in accordance with some exemplary embodiments of the invention. In step 162, the power may be optionally set at a low level so that no substantial heating may take place. However, the power should not be set so low as to prevent signals generated from being reliably detected. Alternatively, calibration may be performed at full or medium power. Calibration at near operational power levels may reduce the dynamic range of some components, for example VCA 106, and reduce their cost.

In step 164, subsystem 92 may provide control signals indicating a plurality of sweeping frequencies to subsystem 96 via interface 130 and subsystem 96 may be configured to apply electromagnetic energy to zone 9 at these plurality of frequencies via antennas 102. Consistent with some heating embodiments, different sweeping parameter may be determine (e.g., by controller 101) for example the sweeping range and/or the sweeping resolution. The sweeping frequencies may be within a range of 300-1000 MHz or even up to 3 GHz, depending on the heating application. Consistent with some embodiments, ranges, for example 860-900 MHz, 800-1000 MHz or 420-440 MHz may also be used. In some embodiments, a range of 430-450 MHz may be used. Consistent with the presently disclosed embodiments, the sweeping range may include several non-contiguous ranges, if more than one continuous range satisfies the criteria for use in a particular application such as heating. A sweep may include the transmission of multiple frequencies in a contiguous frequency band at a predetermined frequency range (e.g., the transmission of multiple frequencies in a frequency band at 0.1 MHz, 0.2 MHz, 0.5 MHz, 1 MHz or any other frequency range).

In step 166, sweeping results may be compared with criteria 156. The sweeping results may be the value indicative of energy absorbable (e.g. dissipation ratio) as a function of the swept frequencies and the criteria may indicate different dissipation ratio threshold values, indicating how much electromagnetic energy may be applied in each frequency. In some embodiments one criterion may be not to apply little or no energy in certain frequencies (e.g. frequencies having dissipation ratio value higher than a threshold value). In some exemplary embodiments, the dissipation ratio for each transmitting antenna may be maximized, i.e., the maximum dissipation ratio within the sweep range may be made as high as possible. The maximum dissipation ratio and the frequency at which the maximum ratio is achieved may then be recorded. Additionally, the width of the dissipation ratio peak and a Q-factor may also be recorded. In some embodiments, the area under each resonance peak of the dissipation ratio (see FIG. 12) may be determined. The dissipation ratio and the center frequency of the resonance that correspond to the maximum area/width may be recorded.

In step 168, it may be determined if the criteria has been met. For example, each frequency may have maximum absorption at a specific location within an object in an energy application zone, and this peak (maximum) energy absorption region (e.g., in the case of FIG. 9, heating region) may vary among different frequencies. Therefore applying electromagnetic energy at a range of frequencies may cause the energy absorption (e.g., heating) region to cover different parts of the object. Computer simulations have shown that, at least when the Q factor of a peak is low (i.e., a significant amount of energy is dissipated in the object being heated), the peak heating region can substantially cover the entire object.

Therefore, consistent with the presently disclosed embodiments, the criteria for determining if the variables are properly set may be that the peak dissipation ratio (in the presently disclosed embodiments) or the area or a width (in other embodiments) is above some predetermined threshold, or a Q-factor is below some predetermined threshold. For example, a threshold may be set such that only the area above 60% dissipation ratio is maximized for each of the antennas.

In step 168, of FIG. 9, if the criteria is not met (step 168: no), process 160 may go to step 172 where heating variables are changed. Steps 164, 166, and 168 may be repetitively performed until the criteria are met. Once the criteria are met (step 168: yes), the power supplied into the respective amplifiers for each antenna may be set such that substantially constant power is absorbed in object 11, in step 174. The power may be raised to a level suitable for heating. Consistent with the presently disclosed embodiments, the least efficient antenna may determine the power supplied to object 11.

In some situations where multiple antennas are used, power may be fed to all of the antennas at the same time using the exemplary subsystem 96 of FIG. 5A. This has the advantage of faster energy application, which, in the case of heating, may result in faster heating. Depending on the circuitry employed, the use of multiple antennas may give rise to the need for more costly circuitry (e.g., multiple sets of circuitry may be needed). Alternatively, if power is fed to the antennas sequentially, each for a short period, such as with the exemplary subsystem of FIG. 5B, circuitry may be reduced, resulting in potentially significant hardware cost savings. Step 174 in FIG. 9 may be followed by step 158 in FIG. 8.

Figure 10:
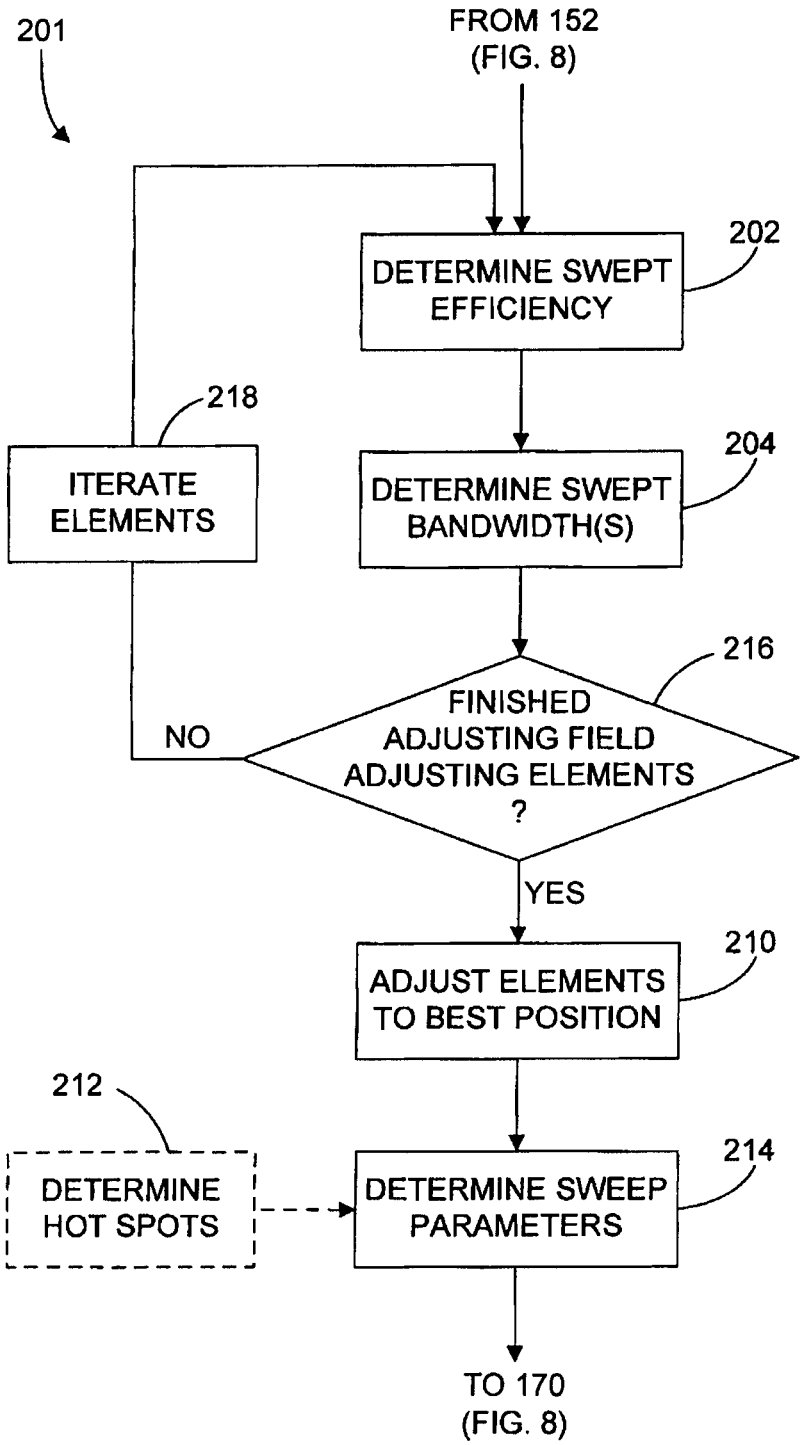
FIG. 10 is a flow chart for a process of determining swept power characteristics, in accordance with some embodiments of the invention.

FIG. 10 is an exemplary flow chart 201 of a method for determining swept power characteristics, in accordance with the presently disclosed embodiments. This method may be used to implement steps 160 and 158 of FIG. 8. After placing object 11 in cavity 10 (step 152 in FIG. 8), cavity 10 may be swept to determine the dissipation efficiency as a function of frequency (step 202 in FIG. 10) (e.g., dissipation ratio spectrum 250 as shown in FIG. 12). In some embodiments, the dissipation ratio may be determined using sequential frequency sweeping as discussed in connection with FIG. 9. In alternative embodiments, a pulse of energy, having a broad spectrum in the range of interested frequencies may be fed into cavity 10. The reflected energy and the energy transmitted to other antennas may be determined and their spectrums analyzed, for example using Fourier analysis. Using either method, the dissipation ratio as a function of frequency may be determined. In the presently disclosed embodiments, where similar objects have been heated previously, a set of look-up tables for different types and sized of objects may be developed and stored in storage device 922 or memory module 923.

In step 204 of FIG. 10, the overall swept bandwidth may be determined. For example, one or more frequencies may be selected, among the sweeping frequencies, to be applied during an energy application process (e.g., heating process).

Figure 13A:
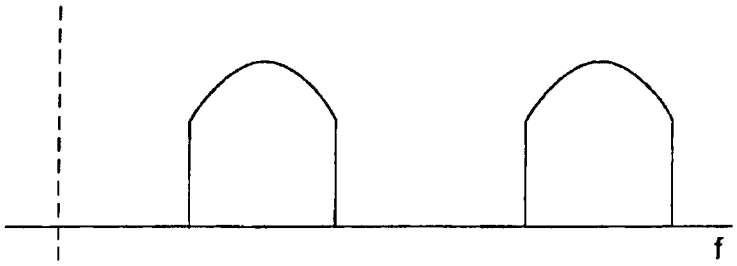
FIGS. 13A and 13B respectively illustrate a truncated absorbable energy spectrum and an input energy spectrum that is a reverse image of the dissipation ratio spectrum, in accordance with some embodiments of the invention.
Figure 13B:
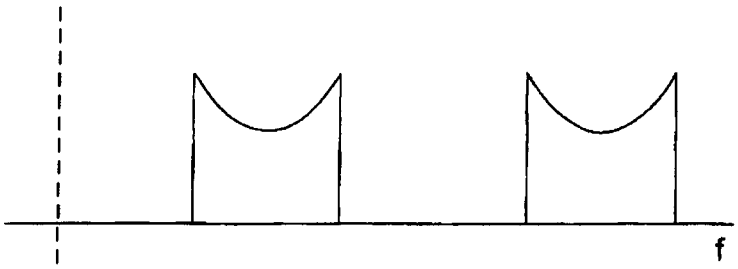

Consistent with the presently disclosed embodiments, step 204 may include sweeping across a single peak or across several peaks of the dissipation ratio. In some embodiments, during the heating phase, the frequency may be swept across a portion of each of the high dissipation ratio peaks. For example, as shown in FIG. 12, a threshold 225 may be set such that only frequencies corresponding to dissipation ratios above the threshold may be used for heating. Additionally or alternatively, frequency ranges corresponding to high Q peaks may be eliminated from the sweeping frequencies. For example, FIG. 13A shows a truncated dissipation ratio spectrum that is above threshold 225 in FIG. 12, after a high Q peak 254 is eliminated. Accordingly, energy may be applied only in the truncated spectrum, as shown in FIG. 13B. Alternatively, energy may be applied in the entire spectrum. In some embodiments, step 204 may be omitted and the swept bandwidth may correspond to substantially all the frequencies that were swept in order to determine the dissipation efficiency (e.g., as detailed in step 202).

However, it is also contemplated that consistent with other embodiments and depending on the particular application (e.g., in a thawing application), frequencies corresponding to a dissipation ratio below a predetermined threshold or within a certain predetermined range may be used such that certain materials or items in object 11 are selectively heated. For example, it is known that water has a dissipation ratio higher than non-water materials. Therefore, by applying energy at frequencies that correspond to low dissipation ratios, the object may be thawed without heating the water inside.

In optional step 216, it may be determined if field adjusting elements 22 and 24 have been properly adjusted. If not (step 216: no), a desired position and/or orientation of the field adjusting elements may be determined during an integrative process 218. In step 218, the positions of field adjusting elements 22 and 24 may be set. This adjustment may be optional and in the presently disclosed embodiments, such elements might not require adjustment. In general, the criterion for such adjustment is that the peaks have as high dissipation ratio as possible with as broad a peak as possible. Depending on specific applications, additional adjustment may be made, for example to move the peak to a certain band.

Consistent with the presently disclosed embodiments, a search may be performed in iterative process 218 for a position of field adjusting elements 22 and 24 at which the dissipation ratio at all of the antennas meets criteria. For example, standard search techniques can be used or a neural network or other learning system can be used, especially if the same type of object is heated repeatedly. It is contemplated that any iterative process known in the art may also be used.

Once it is determined if field adjusting elements 22 and 24 have been properly adjusted (step 216: yes), in step 210, the elements are set to the best positions as determined. In some embodiments, in step 212, the sweep may be adjusted to avoid hot spot (e.g., to avoid feeding excess power into certain parts of the object). For example, if the object contains a metal rod or a metal zipper, a high Q peak 254 may be generated in dissipation ratio, as shown in FIG. 12. A metal rod may cause a concentration of energy near the ends of the rod. Avoiding application of energy at this peak may reduce the effects of such objects on even heating. Alternatively, in some applications, a measured amount of energy application may be desirable even at such peaks, in order to achieve desired effects of a particular application. In step 214, the sweeping parameters may be determined.

Figure 14:
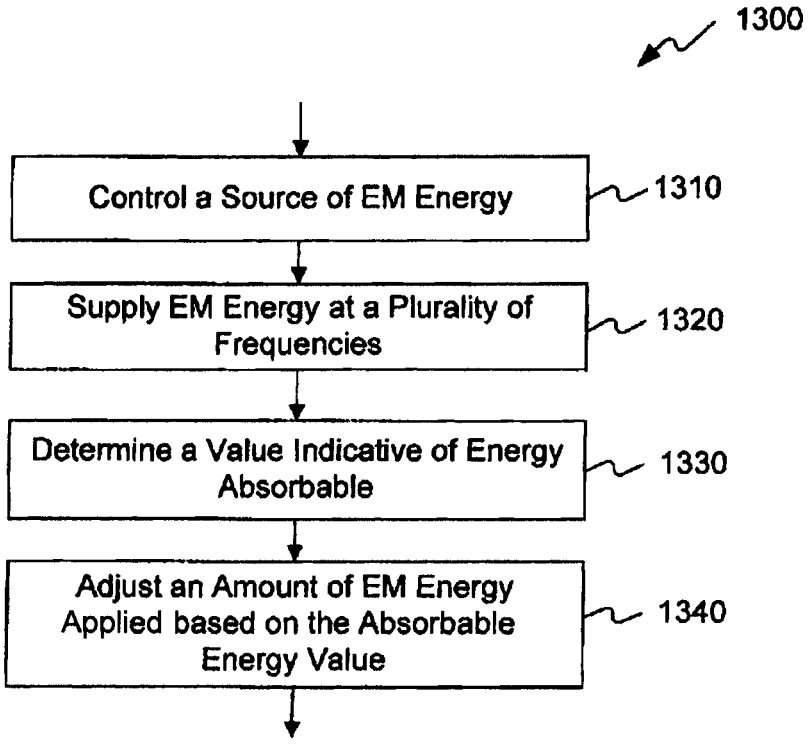
FIG. 14 is a flow chart of exemplary steps of applying electromagnetic energy to an energy application zone in certain embodiments.

The invention may further include a method for applying electromagnetic energy to an object. Electromagnetic energy may be applied to an object, for example, through at least one processor implementing a series of steps of process 1300 of FIG. 14.

In certain embodiments, a method may involve controlling a source of electromagnetic energy. As previously discussed, a "source" of electromagnetic energy may include any components that are suitable for generating electromagnetic energy. By way of example only, in step 1310, the at least one processor may be configured to control a source of EM energy (e.g., electromagnetic energy application subsystem 96).

The source may be controlled in order to apply electromagnetic energy at a plurality of frequencies to at least one radiating element, such as is indicated in step 1320. Various examples of frequency application, including sweeping, as discussed earlier, may be implemented in step 1320. Alternatively, other schemes for controlling the source may be implemented so long as that scheme results in the application of energy at a plurality of frequencies. If exemplary subsystem 96 is employed, in step 1320, the at least one processor may regulate subsystem 96 to apply energy at multiple frequencies to at least one transmitting antenna.

In certain embodiments, the method may further involve determining a value indicative of energy absorbable by the object at each of the plurality of frequencies, in step 1330. An absorbable energy value may include any indicator—whether calculated, measured, derived, estimated or predetermined—of an object's capacity to absorb energy. For example, subsystem 92 may be configured to determine an absorbable energy value (e.g., a dissipation ratio associated with each frequency).

In certain embodiments, the method may also involve adjusting an amount of electromagnetic energy incident or applied at each of the plurality of frequencies based on the absorbable energy value at each frequency. In some embodiments, the method may also involve adjusting an amount of electromagnetic energy incident or applied at a sub-band of the plurality of frequencies based on the absorbable energy value at each frequency. For example, in step 1340, at least one processor may determine an amount of energy to be applied at each frequency, as a function of the absorbable energy value associated with that frequency. In some embodiments, the power level used for applying the EM energy may be adjusted at each of the plurality of frequencies based on the absorbable energy value at each frequency.

Figure 15:
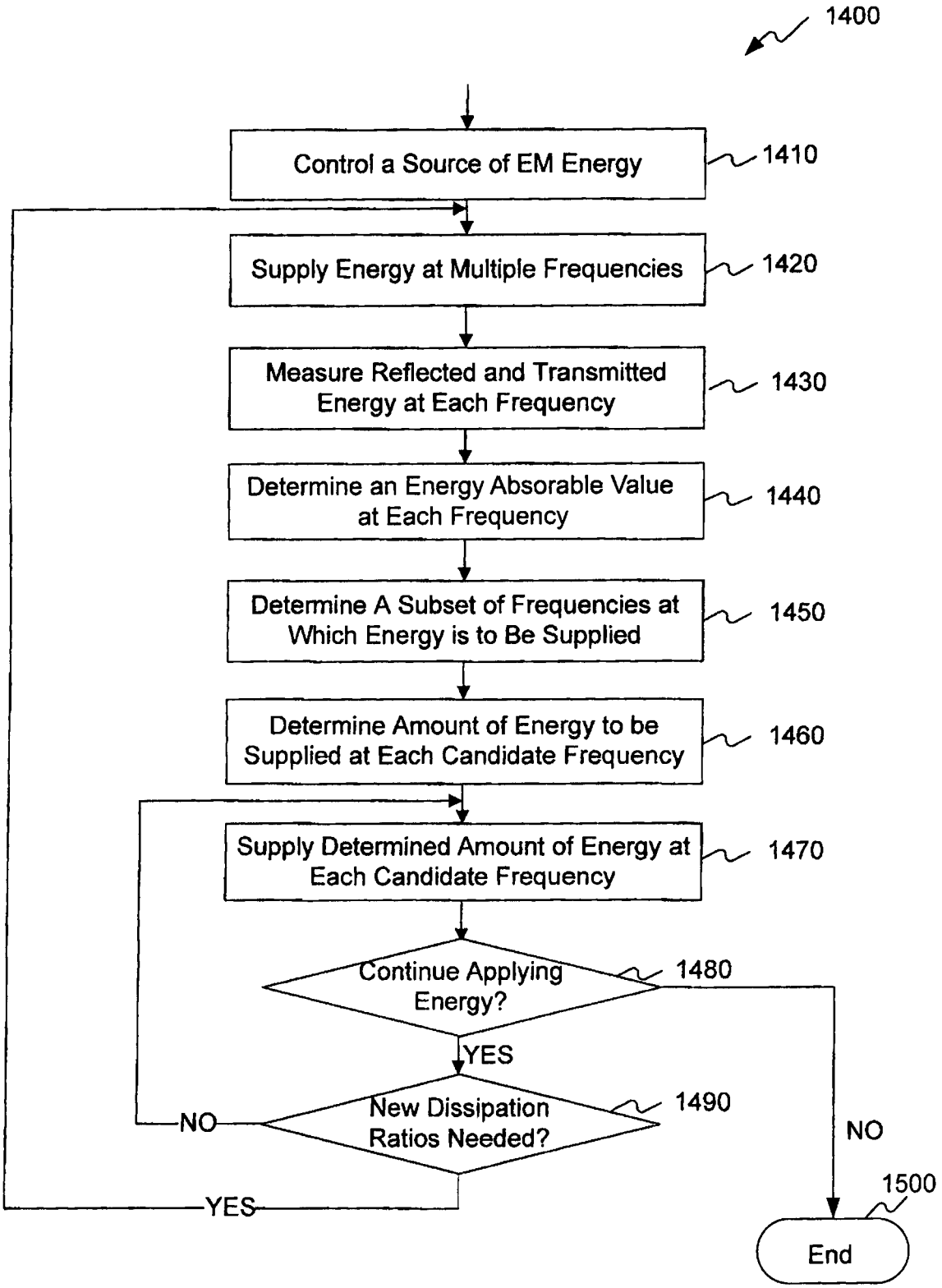
FIG. 15 is a flow chart of another exemplary process for applying electromagnetic energy to an object in an energy application zone in certain embodiments.

FIG. 15 illustrates another exemplary process 1400 for applying electromagnetic energy to an object in an energy application zone according to the presently disclosed embodiments. In step 1410, the at least one processor may be configured to control a source, for example electromagnetic energy application subsystem 96. The control may be performed by regulating one or more components included in subsystem 96. In step 1420, the at least one processor may regulate subsystem 96 to supply energy at multiple frequencies to at least one transmitting antenna. For example, in the presently disclosed embodiments, the at least one processor may cause subsystem 96 to apply energy within a predetermined frequency range, such as a working band of the apparatus. The working band may, for example, be of any width that would support a desired level of control. In the presently disclosed embodiments, the working band may be 50 MHz wide or more or even 100 MHz wide or more, 150 MHz wide or more or even 200 MHz wide or more. In some other embodiments, the at least one processor may dynamically determine a range of frequencies, based on the nature of the application. The frequencies at which energy is applied may be equally spaced in the range, or unequally or randomly spaced. The energy applied to the at least one radiating element (e.g., antenna) may be emitted into energy application zone 9.

In step 1430, the at least one processor may be configured to regulate subsystem 96 to measure reflected energy at the at least one radiating element and transmitted energy at other radiating elements, at each of a plurality of frequencies. Subsystem 96 may be regulated to receive electromagnetic energy reflected at the transmitting antenna and transmitted energy at receiving antennas, and to communicate the measured energy information back to subsystem 92 via interface 130. In the presently disclosed embodiments, reflected power and the transmitted power may be measured, instead of the energy, by subsystem 96. In step 1430, a processor may take into account any indicator the object's capacity to absorb energy, whether calculated, measured, estimated, or derived from memory.

In step 1440, the at least one processor may determine an absorbable energy value. For example, subsystem 92 may be configured to determine the absorbable energy value based on the measurements obtained in step 1430. In the presently disclosed embodiments, the determined value may be a dissipation ratio determined according to formula (1) based on the measured reflected power and transmitted power. In some other embodiments, input reflection coefficients $S_{11}$, $S_{22}$, and $S_{33}$ and transfer coefficients $S_{12}=S_{21}$, $S_{13}=S_{31}$, $S_{23}=S_{32}$ based on the measured power information and the dissipation ratio may be determined according to formula (2).

In step 1450, the at least one processor may determine a subset of frequencies, out of the frequencies used in step 1420 at which energy is to be applied. For example, the at least processor may generate a dissipation ratio spectrum 250 by plotting the dissipation ratio associated with each frequency against the respective frequencies, as illustrated for example in FIG. 12. Based on the spectrum, the at least one processor may select a subset of frequencies from the frequency range. For example, frequencies corresponding to dissipation ratios that satisfy a pre-determined condition may be selected. Exemplary conditions may include situations where the dissipation ratio is greater than a threshold or smaller than a threshold. In the presently disclosed embodiments, the entire frequency range that is used in step 1420 may be selected in step 1450.

In the presently disclosed embodiments, a choice may be made not to use all possible frequencies in a working band, such that the emitted frequencies are limited to a sub band of frequencies where the Q factor in that sub band is smaller or higher than a threshold. Such a sub band may be, for example 50 MHz wide or more or even 100 MHz wide or more, 150 MHz wide or more, or even 200 MHz wide or more. FIG. 13A shows an exemplary sub band of a working band, corresponding to a dissipation ratio spectrum that is above threshold 225 and excludes high Q peak 254. In the presently disclosed embodiments, the choice may be made such that essentially uniform energy dissipation is performed across a whole working band or sub-band. In addition, the choice may be made to cause substantially uniform energy dissipation in at least a selected portion of the object regardless of a location of the object in the zone.

In step 1460, the at least one processor may determine an amount of energy to be supplied to the radiating element at each candidate frequency, e.g., at each of the subset of frequencies or over the whole working band. For example, the energy supplied to the at least one antenna 102 at each of the subset of frequencies may be determined as a function of the absorbable energy value at each frequency (e.g., as a function of a dissipation ratio, maximum incident energy, a combination of the dissipation ratio and the maximum incident energy, or some other indicator). The functional correlation may vary depending upon application. For example, the at least one processor may implement a function that causes a relatively low supply of energy to be supplied at a frequency where absorbable energy value is relatively high. In the presently disclosed embodiments, the energy supplied at each of the subset of frequencies may be determined as a function of the absorbable energy values at one or more frequencies, among the plurality of frequencies, other than or in addition to the frequency at which energy is supplied. For example, FIG. 13B shows an exemplary applied energy spectrum that is substantially a reverse image of the truncated dissipation ratio spectrum shown in FIG. 13A.

In the presently disclosed embodiments, the at least one processor may determine the power level used for applying the determined amount of energy at each frequency, as a function of the absorbable energy value. When making the determination, energy may be applied for a constant amount of time at each frequency. Alternatively, the at least one processor may determine varying durations at which the energy is applied at each frequency, assuming a substantially constant power level. In the presently disclosed embodiments, the at least one processor may determine both the power level and time duration for applying the energy at each frequency.

In step 1470, the at least one processor may cause the source of electromagnetic energy to supply the determined amount of energy to the radiating element at each candidate frequency, e.g., at each of the subset of frequencies. In the presently disclosed embodiments, the amount of energy applied in step 1470 at a particular frequency may be higher than that applied in step 1420 at that frequency. In the presently disclosed embodiments, the amount of energy applied in step 1470 at a particular frequency may be substantially the same as that applied in step 1420 at that frequency.

In the presently disclosed embodiments, controller 101 may be configured to hold substantially constant the amount of time at which energy is applied at each frequency, while varying the power level at each frequency, as determined in step 1460. In some other embodiments, controller 101 may be configured to cause the energy to be supplied to the antenna at a power level substantially equal to a maximum power level of the device, while supplying the energy over varying time durations at each frequency, as determined in step 1460. The energy supplied to the at least one radiating element may be applied to energy application zone 9 and dissipated into object 11. In the presently disclosed embodiments, both the power and duration of energy application at different frequencies may be varied.

In step 1480, the at least one processor may determine if energy application should be continued. For example, a temperature sensor may be used to detect the temperature of at least one portion of object 11. The at least one processor may determine that energy application should be stopped if the temperature reaches a pre-determined threshold. As another example, the at least one processor may determine that energy application should be stopped if energy has been applied for a pre-determined amount of time or if a predetermined amount of energy was dissipated into the object.

Accordingly, if there is no need for further application of energy (step 1480: NO), process 1400 may terminate in step 1500.

If further application of energy is desired (step 1480: YES), the at least one processor may determine if new energy absorbable values need to be determined, in step 1490. Because absorbable energy can change based on a host of factors including object temperature, depending on application, it may be beneficial to regularly update absorbable energy values and thereafter adjust energy application based on the updated absorption values. In the presently disclosed embodiments, the at least one processor may determine to update the dissipation ratios every 10 milliseconds. Alternatively or additionally, other updating rates may be used, for example once in 5 seconds or any value in-between the aforementioned. Depending on the application, updating rates greater than 5 seconds may also be chosen. In the presently disclosed embodiments, the at least processor may be configured to monitor certain characteristic parameters associated with object 11, for example the temperature of object 11, and dynamically determine if an update is necessary.

If an update is not needed (step 1490: NO), process 1400 may be redirected to step 1470 and cause the source to continue supplying energy to the radiating elements. If an update is needed (step 1490: YES), process 1400 may be redirected to step 1420 and determine the absorbable energy values and amount of energy to be supplied at each frequency again.

In the foregoing Description of Exemplary Embodiments, various features are grouped together in a single embodiment for purposes of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate embodiment of the invention.

Moreover, it will be apparent to those skilled in the art from consideration of the specification and practice of the present disclosure that various modifications and variations can be made to the disclosed systems and methods without departing from the scope of the invention, as claimed. Thus, it is intended that the specification and examples be considered as exemplary only, with a true scope of the present disclosure being indicated by the following claims and their equivalents.

What is claimed is:

1. An apparatus for applying radio frequency (RF) energy to an object in an energy application zone within a resonator cavity via at least one radiating element, the apparatus comprising:

a source configured for connection to the at least one radiating element to supply RF energy to the energy application zone; and at least one processing device configured to:

determine a value indicative of RF energy absorbable by the object at each of a plurality of frequencies; and during a heating period, cause RF energy to be supplied to the at least one radiating element at three or more radio frequencies among the plurality of frequencies, such that the amount of RF energy supplied to the at least one radiating element varies across the three or more radio frequencies inversely with respect to the value indicative of RF energy absorbable by the object at the respective ones of the three or more radio frequencies, wherein the three or more radio frequencies at which RF energy is supplied to the at least one radiating element are each associated with a corresponding value indicative of RF energy absorbable by the object that exceeds a predetermined threshold.

2. The apparatus of claim 1, wherein the RF energy supplied to the at least one radiating element emanates from the source.

3. The apparatus of claim 2, wherein the at least one processing device is further configured to:

determine at least one frequency, among the plurality of frequencies, wherein the value indicative of RF energy absorbable by the object exceeds a predetermined threshold; and cause the RF energy to be supplied to the at least one radiating element at the at least one frequency at an RF energy level less than a maximum incident RF energy associated with a power amplifier supplying the RF energy to the at least one radiating element.

4. The apparatus of claim 1, further comprising at least one antenna, wherein the at least one radiating element includes the at least one antenna.

5. The apparatus of claim 1, wherein the at least one processing device is further configured to adjust at least one of a location, an orientation, and a configuration of the at least one radiating element.

6. The apparatus of claim 4, wherein the at least one antenna includes a single antenna configured to apply RF energy to the energy application zone and to receive RF energy from the energy application zone.

7. The apparatus of claim 1, further including the resonator cavity.

8. The apparatus of claim 1, wherein the at least one radiating element includes a plurality of antennas, at least one of the plurality of antennas being configured to apply RF energy to the energy application zone and to receive RF energy via the energy application zone.

9. The apparatus of claim 1, wherein the at least one processing device is configured to cause the at least one radiating element to apply RF energy to the object in a predetermined amount to heat at least a portion of the object.

10. The apparatus of claim 1, wherein the at least one processing device is configured to cause substantially uniform energy dissipation in at least a selected portion of the object regardless of a location of the object in the energy application zone.

11. The apparatus of claim 1, wherein the at least one processing device is configured to cause substantially uniform energy dissipation in the object regardless of a location of the object in the energy application zone.

12. The apparatus of claim 1, wherein the value indicative of energy absorbable by the object at each frequency is a function of a dissipation ratio at the corresponding frequency.

13. The apparatus of claim 1, wherein the at least one processing device is further configured to:

receive a measurement of a first amount of incident RF energy at a transmitting antenna at a first frequency;

receive a measurement of a second amount of RF energy reflected at the transmitting antenna as a result of the first amount of incident RF energy;

receive a measurement of a third amount of RF energy transmitted to a receiving antenna as a result of the first amount of incident RF energy; and determine a dissipation ratio at the first frequency based on the first amount, the second amount, and the third amount.

14. The apparatus of claim 1, wherein the at least one processing device is further configured to regulate RF energy supplied to the at least one radiating element so that an amount of RF energy absorbed by the object at each radio frequency is substantially the same.

15. The apparatus of claim 1, wherein the at least one processing device is further configured to:

determine at least one frequency, among the plurality of frequencies, wherein the value indicative of RF energy absorbable by the object exceeds a predetermined threshold; and prevent RF energy from being supplied to the at least one radiating element at the at least one frequency.

16. The apparatus of claim 1, wherein the at least one processing device is further configured to:

determine at least one frequency, among the plurality of frequencies, wherein the value indicative of RF energy absorbable by the object is below a predetermined threshold; and cause RF energy to be supplied to the at least one radiating element at the at least one frequency at an RF energy level substantially equal to a maximum incident RF energy that can be supplied to the radiating element by the source.

17. The apparatus of claim 1, wherein the at least one processing device is further configured to:

determine at least one frequency, among the plurality of frequencies, wherein the value indicative of RF energy absorbable by the object is below a predetermined threshold; and prevent RF energy from being supplied to the at least one radiating element at the at least one frequency.

18. The apparatus of claim 1, wherein the at least one processing device is further configured to cause RF energy to be supplied to the at least one radiating element at the three or more radio frequencies among the plurality of frequencies, and wherein power levels applied at the three or more radio frequencies vary across at least some of the three or more radio frequencies, while amounts of time at which RF energy is applied at the three or more radio frequencies remain substantially constant over the three or more radio frequencies.

19. The apparatus of claim 1, wherein the at least one processing device is further configured to cause RF energy to be supplied to the at least one radiating element at the three or more radio frequencies among the plurality of frequencies, wherein both amounts of time and power levels at which RF energy is applied at each of the three or more radio frequencies vary across the three or more radio frequencies.

20. The apparatus of claim 1, wherein the at least one processing device is further configured to cause RF energy to be supplied to the at least one radiating element at the three or more radio frequencies among the plurality of frequencies, wherein amounts of time at which RF energy is applied at each of the three or more radio frequencies vary across at least some of the three or more radio frequencies, while power levels applied at the three or more radio frequencies remain substantially constant over the three or more radio frequencies.

21. The apparatus of claim 1, wherein the three or more radio frequencies at which RF energy is supplied to the at least one radiating element are included in a frequency band within which the value indicative of RF energy absorbable by the object exceeds a predetermined threshold.

22. The apparatus of claim 1, wherein the three or more radio frequencies at which RF energy is supplied to the at least one radiating element are included in two or more frequency bands within which the value indicative of RF energy absorbable by the object exceeds a predetermined threshold and wherein the two or more frequency bands are separated by at least one frequency for which the value indicative of RF energy absorbable by the object does not exceed the predetermined threshold.

23. The apparatus of claim 1, wherein the three or more radio frequencies at which RF energy is supplied to the at least one radiating element are included as part of an applied energy spectrum that is substantially a reverse image of a corresponding dissipation ratio spectrum represented by determined values indicative of RF energy absorbable by the object at each of a plurality of frequencies.

24. The apparatus of claim 1, wherein an incident power spectrum increases over a frequency range having a width of 10 MHz or more, and a dissipation ratio spectrum decreases over the said frequency range.

25. An apparatus for applying radio frequency (RF) energy to an object in an energy application zone within a resonator cavity via at least one radiating element, the apparatus comprising:

a source configured for connection to the at least one radiating element to supply RF energy to the energy application zone; and at least one processing device configured to:

determine a value indicative of RF energy absorbable by the object at each of a plurality of radio frequencies;

during a heating period, cause RF energy to be supplied to the at least one radiating element at two or more radio frequencies among the plurality of frequencies; and vary time periods during which the RF energy is supplied at respective ones of the two or more radio frequencies such that the amount of RF energy supplied to the at least one radiating element varies across the two or more radio frequencies inversely with respect to the value indicative of RF energy absorbable by the object at the respective ones of the two or more radio frequencies, wherein the two or more radio frequencies at which RF energy is supplied to the at least one radiating element are each associated with a corresponding value indicative of RF energy absorbable by the object that exceeds a predetermined threshold.

26. The apparatus of claim 25, wherein during the heating period, the apparatus causes the RF energy to be supplied to the at least one radiating element at the two or more radio frequencies among the plurality of frequencies at a constant power level.

27. The apparatus of claim 25, wherein the two or more radio frequencies at which RF energy is supplied to the at least one radiating element are included in a frequency band within which the value indicative of RF energy absorbable by the object exceeds a predetermined threshold.

28. The apparatus of claim 25, wherein the two or more radio frequencies at which RF energy is supplied to the at least one radiating element are included in two or more frequency bands within which the value indicative of RF energy absorbable by the object exceeds a predetermined threshold, and wherein the two or more frequency bands are separated by at least one frequency for which the value indicative of RF energy absorbable by the object does not exceed the predetermined threshold.

29. The apparatus of claim 25, wherein the two or more radio frequencies at which RF energy is supplied to the at least one radiating element are included as part of an applied energy spectrum that is substantially a reverse image of a corresponding dissipation ratio spectrum represented by determined values indicative of RF energy absorbable by the object at each of a plurality of frequencies.

30. An apparatus for applying radio frequency (RF) energy to an object in an energy application zone within a resonator cavity via at least one radiating element, the apparatus comprising:

a source configured for connection to the at least one radiating element to supply RF energy to the energy application zone; and at least one processing device configured to:

determine a value indicative of RF energy absorbable by the object at each of a plurality of frequencies;

during a heating period, cause RF energy to be supplied to the at least one radiating element at three or more radio frequencies among the plurality of frequencies, such that the amount of RF energy supplied to the at least one radiating element varies across the three or more radio frequencies inversely with respect to the value indicative of RF energy absorbable by the object at the respective ones of the three or more radio frequencies; and cause RF energy to be supplied to the at least one radiating element at the three or more radio frequencies among the plurality of frequencies, wherein amounts of time at which RF energy is applied at each of the three or more radio frequencies vary across at least some of the three or more radio frequencies, while power levels applied at the three or more radio frequencies remain substantially constant over the three or more radio frequencies.

31. An apparatus for applying radio frequency (RF) energy to an object in an energy application zone within a resonator cavity via at least one radiating element, the apparatus comprising:

a source configured for connection to the at least one radiating element to supply RF energy to the energy application zone; and at least one processing device configured to:

determine a value indicative of RF energy absorbable by the object at each of a plurality of radio frequencies;

during a heating period, cause RF energy to be supplied to the at least one radiating element at two or more radio frequencies among the plurality of frequencies; and vary time periods during which the RF energy is supplied at respective ones of the two or more radio frequencies such that the amount of RF energy supplied to the at least one radiating element varies across the two or more radio frequencies inversely with respect to the value indicative of RF energy absorbable by the object at the respective ones of the two or more radio frequencies, wherein during the heating period, the apparatus causes the RF energy to be supplied to the at least one radiating element at the two or more radio frequencies among the plurality of frequencies at a constant power level.

* * * * *